US009277310B1

(12) United States Patent
Nohr et al.

(10) Patent No.: US 9,277,310 B1
(45) Date of Patent: Mar. 1, 2016

(54) AUDIO PLAYBACK SYSTEM

(71) Applicants: Steven Nohr, Bothell, WA (US); Doug Sandau, Port Angeles, WA (US)

(72) Inventors: Steven Nohr, Bothell, WA (US); Doug Sandau, Port Angeles, WA (US)

( * ) Notice: Subject to any disclaimer, the term of this patent is extended or adjusted under 35 U.S.C. 154(b) by 14 days.

(21) Appl. No.: 14/471,691

(22) Filed: Aug. 28, 2014

Related U.S. Application Data

(60) Provisional application No. 61/871,300, filed on Aug. 28, 2013.

(51) Int. Cl.
*H04R 1/10* (2006.01)

(52) U.S. Cl.
CPC ..... *H04R 1/1041* (2013.01)

(58) Field of Classification Search
None
See application file for complete search history.

(56) References Cited

U.S. PATENT DOCUMENTS

| | | | | |
|---|---|---|---|---|
| 5,197,332 | A | 3/1993 | Shennib | |
| 6,606,506 | B1 | 8/2003 | Jones | |
| 7,254,368 | B1 | 8/2007 | Okada | |
| 7,957,550 | B2 | 6/2011 | Jih-Fon | |
| 8,213,666 | B2 * | 7/2012 | Groesch | H04R 1/1091 381/376 |
| 2001/0003542 | A1 * | 6/2001 | Kita | H04R 1/005 381/334 |
| 2004/0187184 | A1 | 9/2004 | Rubin | |
| 2009/0290742 | A1 | 11/2009 | Rosener | |
| 2012/0039481 | A1 | 2/2012 | McClain | |
| 2014/0192994 | A1 * | 7/2014 | Chen | H04R 1/1083 381/71.6 |

OTHER PUBLICATIONS

Parrot "Zik" headphones, http://www.parrot.com/zik/usa/.

* cited by examiner

*Primary Examiner* — Paul Huber
(74) *Attorney, Agent, or Firm* — QuickPatents, LLC; Kevin Prince

(57) ABSTRACT

An audio playback system for an audio signal generated by an audio output device includes a generally U-shaped headphone arrangement having two opposing ends each terminating with an audio transducer. A top enclosure of the headphone arrangement includes a remote control holder, a personal attachment holder, and a headphone circuit. A remote control is adapted for selective engagement with the remote control holder of the headphone arrangement and is fixable to a personal attachment and worn by the user. Control signals are transmitted to the headphone arrangement by the remote control in response to the person interacting with the remote control. The headphone circuit alters the audio output of the headphone circuit in accordance thereto. The headphone circuit receives the audio signal directly from the audio output device, the network, or indirectly from the remote control. The remote control is also adapted for controlling the audio output device and network.

28 Claims, 15 Drawing Sheets

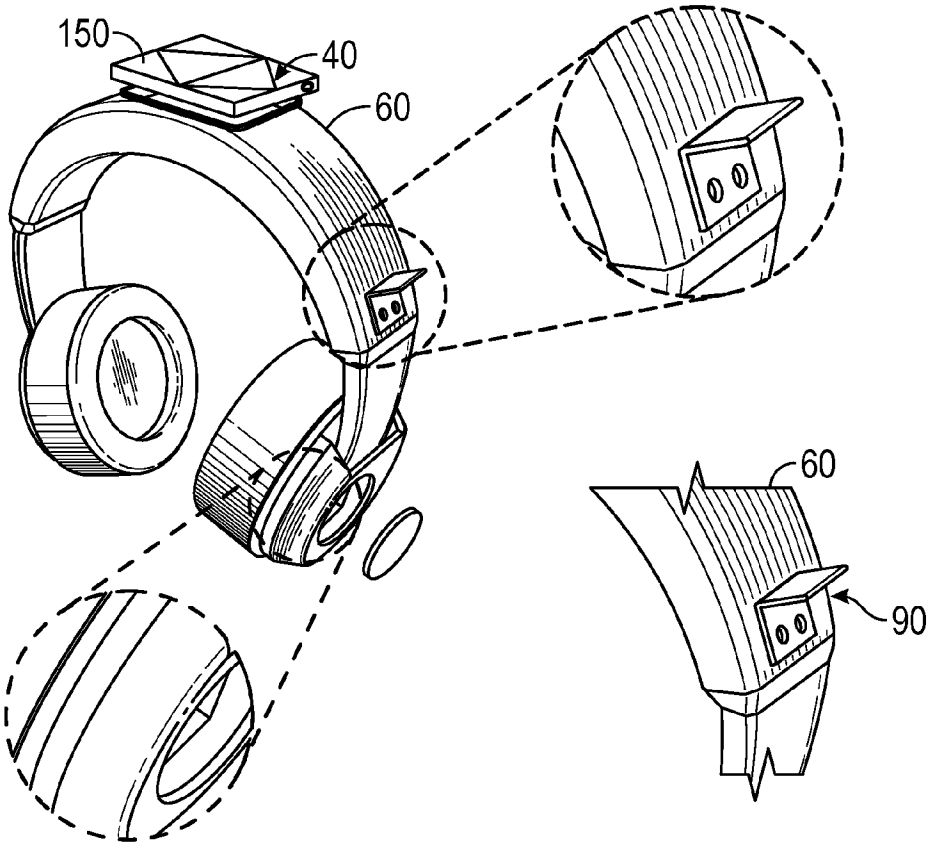
FIG. 3B
FIG. 3C
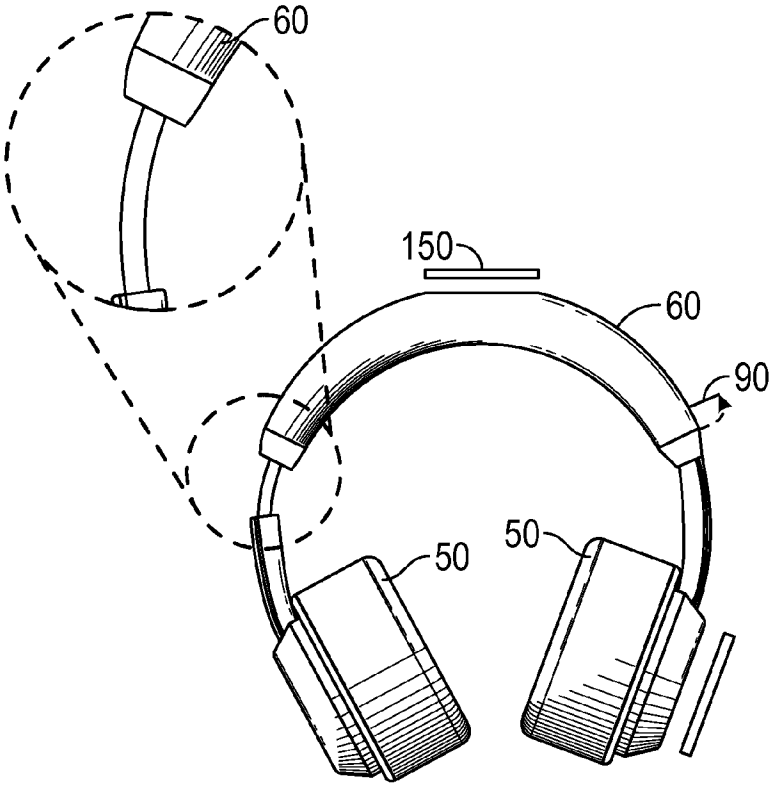
FIG. 3A

AUDIO PLAYBACK SYSTEM

CROSS-REFERENCE TO RELATED APPLICATIONS

This application claims the benefit of U.S. Provisional Patent Application 61/871,300, filed on Aug. 28, 2013, and incorporated herein by reference.

STATEMENT REGARDING FEDERALLY SPONSORED RESEARCH AND DEVELOPMENT

Not Applicable.

FIELD OF THE INVENTION

This invention relates to audio playback systems, and more particularly to an audio playback system with a remote control.

DISCUSSION OF RELATED ART

Current audio playback transducers such as speakers, earphones, headphones, and the like provide minimal control capabilities for the audio output of an audio output device. Volume control and on/off controls are about the limit when providing on-headphone control of the audio output of such prior art devices. While some headphone prior art devices include a remote control, none of the prior art allows for a remote control easily removable from the headphones and then worn on a person's clothing, wrist, or the like. Further, such prior art remote controls are significantly limited in their functionality and do not provide options to the user for changing an audio source, for example.

Therefore, there is a need for a device that allow for convenient wearing of a remote control for a headphone arrangement, and for playback of an audio signal from an audio output device through the headphone arrangement. Such a needed device would provide for controlling an audio output of the headphone arrangement directly by sending control signals to the headphone arrangement, or indirectly by sending control signals to the audio output device. Alternately, the needed device would control the audio output of the headphone arrangement by sending a modified audio signal received from the audio output device or wide area network to the headphone arrangement. Such a needed invention would allow easy storing of the remote and a personal attachment within the headphone arrangement while not in use. The present invention accomplishes these objectives.

SUMMARY OF THE INVENTION

The present device is an audio playback system for an audio signal generated by an audio output device. A generally U-shaped headphone arrangement has two opposing ends each terminating with an audio transducer.

A top enclosure of the headphone arrangement includes a remote control holder, a remote sensor such as a switch, a personal attachment holder, and a headphone circuit. The headphone circuit includes a signal input adapted to receive the audio signal generated by the audio output device, a power source, a wireless control signal input, and an audio output that is electrically connected with each audio transducer. The signal input of the headphone circuit may be a wireless signal receiver for receiving a wireless audio signal.

The audio playback system further includes a remote control that comprises an enclosure adapted for selective engagement with the remote control holder of the headphone arrangement. Further, the remote control is subject to detection by the remote sensor. The remote control further includes a remote circuit having a control signal transmitter, a power source and a user interface.

In one embodiment, the remote circuit further includes a second signal input adapted to receive the audio signal generated by the audio output device, and an audio signal transmitter adapted for transmitting the audio signal to the signal input of the headphone circuit. In such an embodiment, the headphone circuit receives the audio signal from the remote control, not from the audio output device itself.

Preferably the user interface of the remote control includes a touch-sensitive display screen, such that variable user interface controls are displayed to the person on the display screen and changed by the person interacting with the display screen. The remote circuit in such an embodiment further includes at least a processor for displaying the interface controls and storing their values in a memory.

The control signal transmitter is configured for sending control signals to the control signal input of the headphone circuit. In one embodiment, the control signal transmitter is configured for sending the control signals to both the headphone arrangement and, wherein the audio output device includes a two-way wireless receiver, to the audio output device.

In one preferred embodiment, the remote circuit further includes a wireless interface accessible through a wireless communications network. The wireless interface in such an embodiment is adapted for loading selected software applications into the memory through the wireless communications network. The remote circuit further includes an operating system programmed into the memory for controlling the user interface. In such an embodiment the wireless audio signal may additionally be received over the wireless communications network.

A personal attachment is adapted to be fixed with the enclosure of the remote control and, in a worn configuration, for attachment with the person. In a stowed configuration the personal attachment is fixed with the personal attachment holder of the headphone arrangement.

In use, the person detaches the remote control from the remote control holder, and the personal attachment from the personal attachment holder and affixes the remote control to the personal attachment, if necessary. The person then wears the personal attachment. Control signals are transmitted to the control signal input of the headphone arrangement by the control signal transmitter in response to the person interacting with the user interface. The headphone circuit alters the audio output of the headphone circuit in accordance thereto. When the person is finished listening to the audio output the personal attachment and the remote control are stowed in the headphone arrangement, whereby the headphone circuit is deactivated by the remote sensor.

Multiple headphone arrangements may be included for receiving the control signals from the remote control, wherein a master headphone arrangement includes the remote control and each additional headphone arrangement does not include the remote control holder but is rather designated a "slave" headphones.

The present invention allows for convenient wearing of a remote control and a personal attachment device for a headphone arrangement, and for playback of an audio signal from an audio output device through the headphone arrangement. The present system provides for controlling an audio output of the headphone arrangement directly by sending control signals to the headphone arrangement, or indirectly by sending control signals to the audio output device. Alternately, the present device controls the audio output of the headphone arrangement by sending a modified audio signal received from the audio output device or wide area network to the headphone arrangement. The present invention allows easy storing of the remote and a personal attachment within the headphone arrangement while not in use. Other features and advantages of the present invention will become apparent from the following more detailed description, taken in conjunction with the accompanying drawings, which illustrate, by way of example, the principles of the invention.

DESCRIPTION OF THE DRAWINGS

FIG. 3A is a front elevational view of an alternate embodiment of the invention;

FIG. 3B is a perspective view of a FIG. 3A;

FIG. 3C is a partial view of FIG. 3B;

DETAILED DESCRIPTION OF THE PREFERRED EMBODIMENT

Figure 1A:
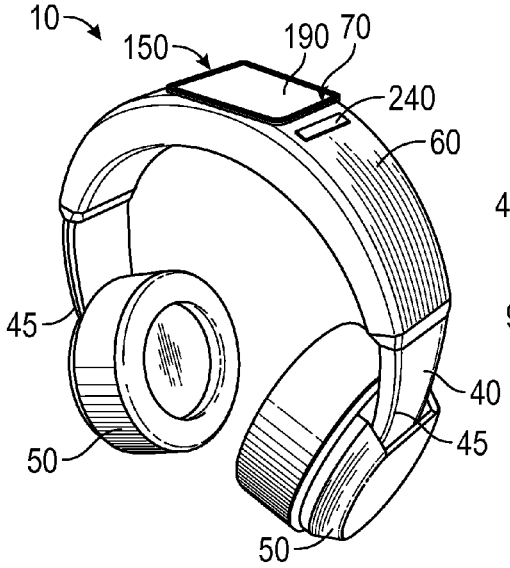
FIG. 1A is a left perspective view of one embodiment of the invention.
Figure 1B:
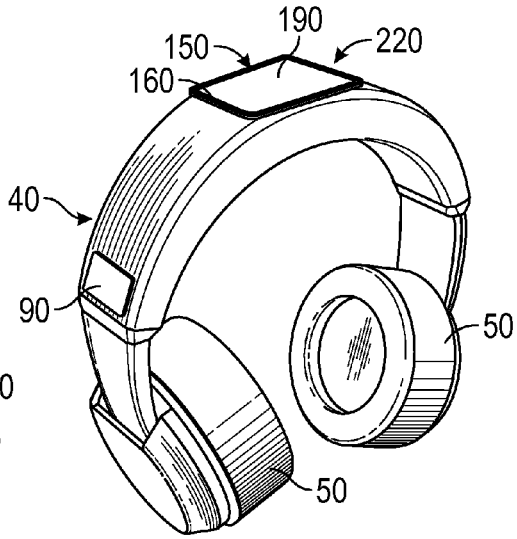
FIG. 1B is a right perspective view of FIG. 1A, showing a headphone arrangement of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1A-2B and 4A-4B illustrate an audio playback system 10 for an audio signal 21 generated by an audio output device 20, such as an audio receiver, a portable media or mp3 player, a laptop or desktop computer, a notebook or tablet-type computer, a cellular or "smart" phone, a game player or console, a television, cable box, a network-connected media player, a home or portable entertainment system, or the like.

A generally U-shaped headphone arrangement 40 has two opposing ends 45 each terminating with an audio transducer 50, such as a speaker. Each audio transducer 50 preferably pivots on a pivot arrangement (FIG. 3B) that allows the angular position of each audio transducer 50 with respect to a person's head 33 to be adjusted as suited by the person 30. The headphone arrangement 40 is preferably padded for comfort against the person's head, and each transducer 50 may be adjusted vertically with respect to the headphone arrangement 40 to adapt to the size of the person 30 (FIG. 3A).

Figure 6:
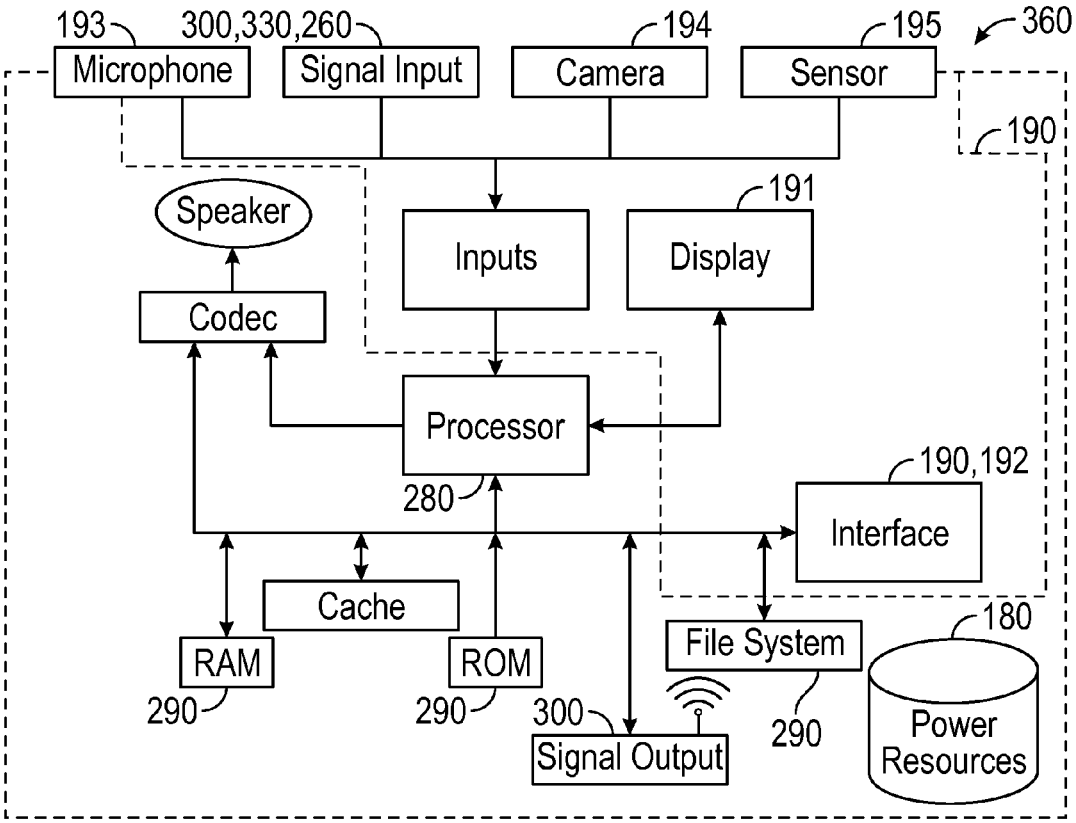
FIG. 6 is a block diagram of the functional attributes of one embodiment of a remote control circuit of the remote control.

A top enclosure 60 of the headphone arrangement 40 includes a remote control holder 70, a remote sensor 80 such as a switch 81 (FIG. 6), a personal attachment holder 90 (FIGS. 2A and 3C), and a headphone circuit 100. The top enclosure 60 may be a rigid enclosure, preferably padded, and preferably made from a lightweight material such as plastic, steel, aluminum, carbon fiber materials, Kevlar-type materials, or other suitable materials.

The headphone circuit 100 includes a signal input 110 adapted to receive the audio signal 21 generated by the audio output device 20, a power source 120 such as a battery or an AC adapter output, a wireless control signal input 130, and an audio output 140 that is electrically connected with each audio transducer 50.

In one embodiment the signal input 110 is an electronic jack 250 traversing the headphone arrangement 40 (preferably towards the bottom of one of the audio transducers 50) and adapted for selectively receiving an audio plug 23 of an audio signal line 24 that is electrically connected with the audio output device 20. The audio plug 23 and audio signal line 24 are not part of the claimed invention but rather can be purchased from any electronics store.

Alternately, the signal input 110 of the headphone circuit 100 may be a wireless signal receiver 111 for receiving a wireless audio signal 22, such as may be broadcast by the audio output device 20 (FIG. 5B), a wireless network (FIG. 8A), a Bluetooth-type device, a cellular data network, an FM or AM broadcast tower, satellite network, or the like. In one embodiment, a auxiliary wireless broadcast transmitter (not shown) may be included that converts the audio signal 21 into the wireless audio signal 22 for reception by the headphone circuit 100. Such an auxiliary wireless broadcast transmitter may be plugged into a headphone jack (not shown) of the audio output device 20, for example, obtaining the audio signal 21 from the headphone jack and then converting it to the wireless audio signal 22.

The audio playback system further includes a remote control 150 that comprises an enclosure 160 adapted for selective engagement with the remote control holder 70 of the headphone arrangement 40. Further, the remote control 150 is subject to detection by the remote sensor 80. The remote control 150 further includes a remote circuit 360 having a control signal transmitter 170, a power source 180 such as a rechargeable battery, removable lithium-ion batteries, AA or AAA batteries, or an AC adapter output, and a user interface 190.

Figure 5A:
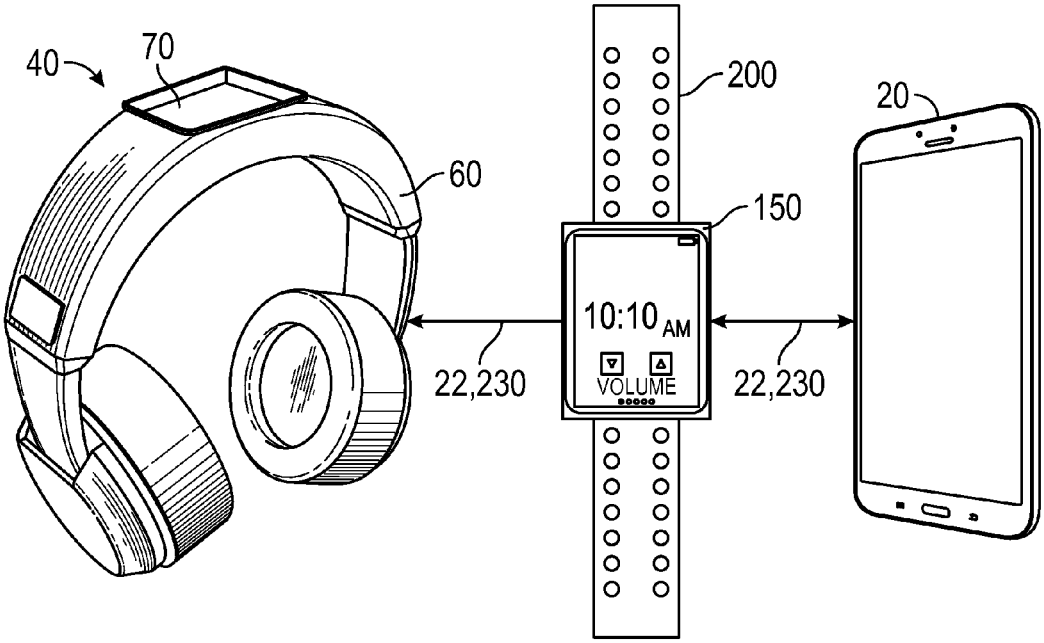
FIG. 5A is a diagram of wireless signal interactions between the headphone arrangement and the remote control, and the remote control and a so-called "smart phone" audio output device.
Figure 5B:
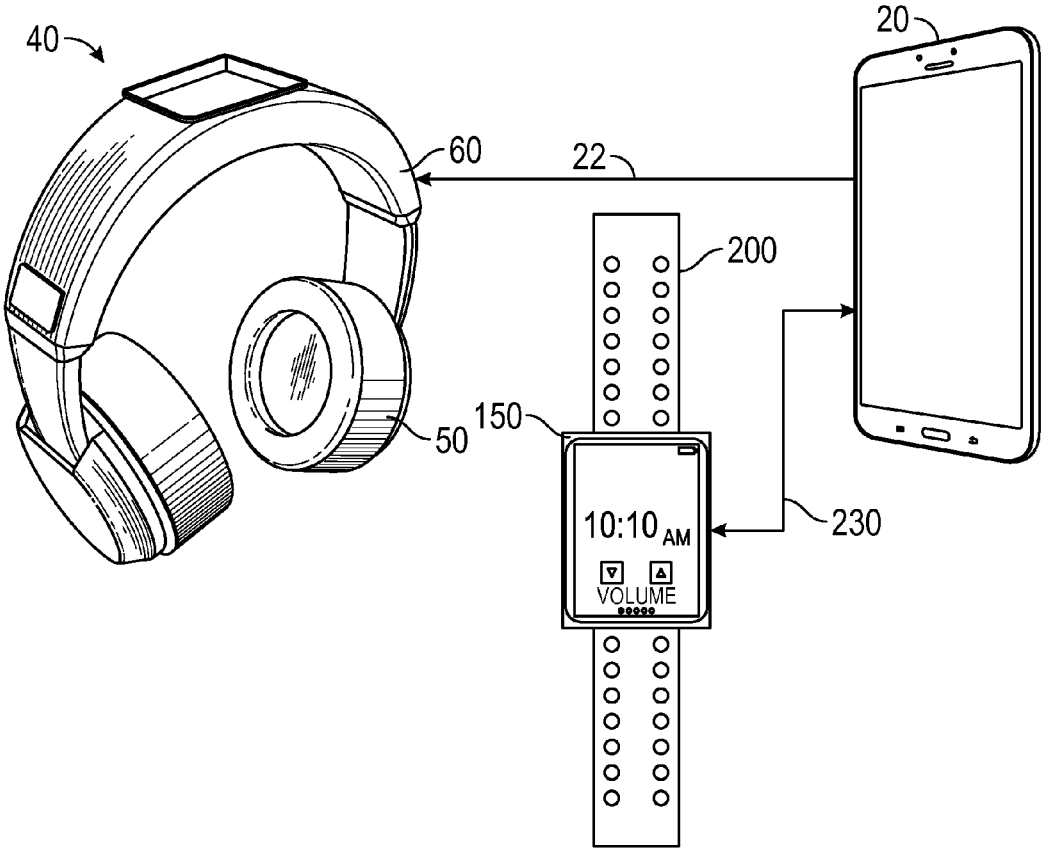
FIG. 5B is a diagram of wireless signal interactions between the headphone arrangement and the audio output device, and the remote control and the audio output device.
Figure 10A:
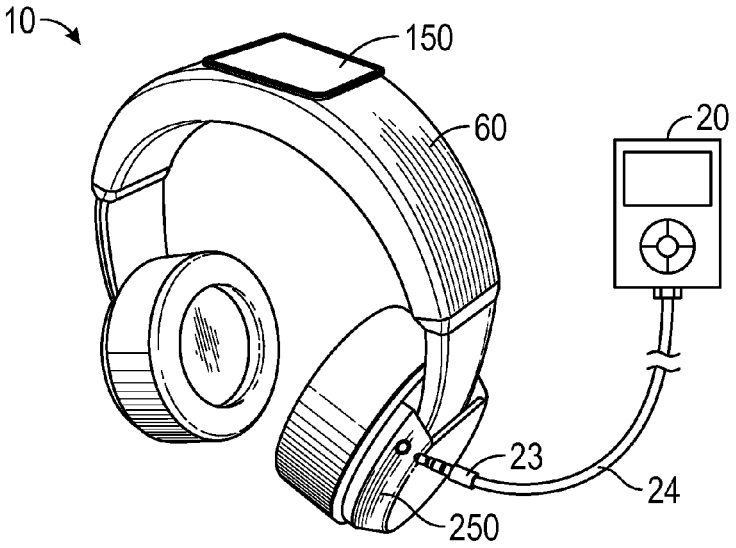
FIG. 10A is a perspective view of an embodiment of the headphone arrangement having an integrated remote control holder and personal attachment holder.

In one embodiment, the remote circuit 360 further includes a second signal input 260 adapted to receive the audio signal 21 generated by the audio output device 20, and an audio signal transmitter 270 adapted for transmitting the audio signal 21 to the signal input 110 of the headphone circuit 100 (FIG. 5A). In such an embodiment, the headphone circuit 100 receives the audio signal 21 from the remote control 150, not from the audio output device 20 itself. A selector switch or control (not shown) may be included for toggling between signal inputs of either the audio output device 20 or the remote control 150, for example. The second signal input 260 of the remote circuit 360 may be one of the electronic jacks 250 (FIG. 10A), for example. Alternately, the second signal input 260 of the remote circuit 360 may be one of the wireless signal receivers 111 for receiving the wireless audio signal 22.

Preferably the user interface 190 of the remote control 150 includes a touch-sensitive display screen 191, such that variable user interface controls 192 are displayed to the person 30 on the display screen 191 and changed by the person 30 interacting with the display screen 191. The remote circuit 360 in such an embodiment further includes at least a processor 280 for displaying the interface controls 192 and storing their values in a memory 290.

The control signal transmitter 170 is configured for sending control signals 230 to the control signal input 130 of the headphone circuit 100, such as volume control signals for affecting a change in the volume of the audio output through the audio transducers 50, balance control signals for changing the relative volume between the two audio transducers 50, on/off commands for turning the audio transducers 50 off, and the like. In one embodiment, the control signal transmitter 170 is configured for sending the control signals 230 to both the headphone arrangement 40 and, wherein the audio output device 20 includes a two-way wireless receiver, to the audio output device 20. In such an embodiment the remote control 150 may be used to send control signals 230 to the audio output device 20 such as the commands listed above, plus audio signal input selection, skip track or back commands, a pause command, or the like.

In one embodiment, the user interface 190 of the remote control 150 further includes a microphone 193 and the remote circuit 360 is adapted for receiving commands from the person 30 by voice recognition. Further, the user interface 190 may include a camera 194, and the remote circuit 360 may be adapted for receiving commands from the person 30 by gesture recognition. Still further, the user interface 190 may include at least one tilt sensor 195, such that the remote circuit 360 may receive commands from the person 30 by tilting of the remote control 150.

Figure 9A:
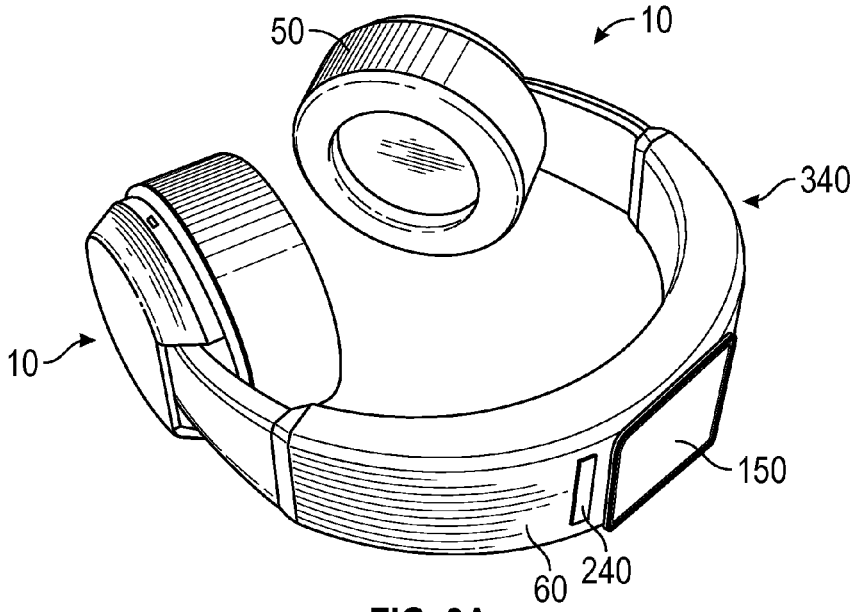
FIG. 9A is a perspective view of an embodiment of the headphone arrangement having a microphone.
Figure 9B:
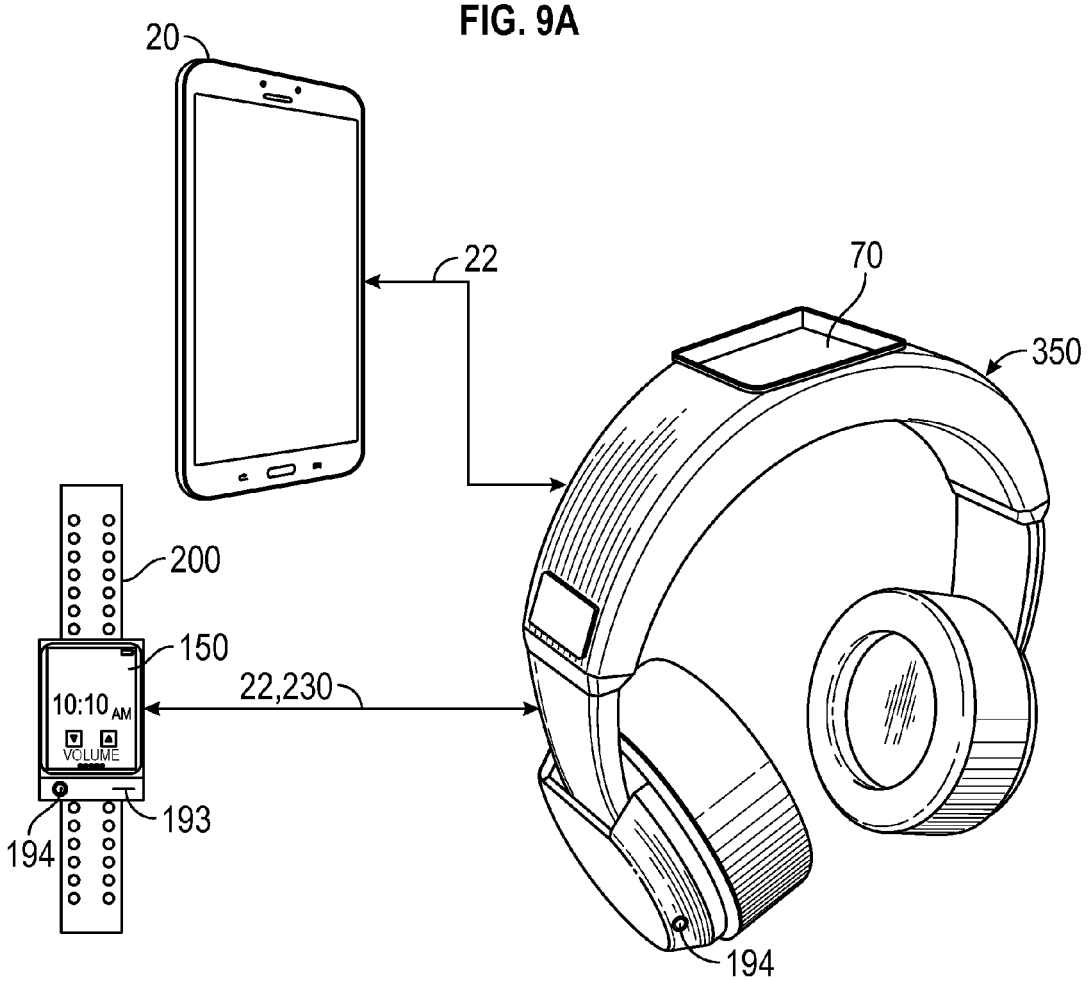
FIG. 9B is a perspective view of an embodiment of the headphone arrangement having a camera.

Preferably the headphone circuit 100 further includes a second tilt sensor 310 and a feedback transmitter 320, and the remote circuit 360 further includes a feedback signal receiver 330, such that upon detection by the second tilt sensor 310 that the orientation of the headphone arrangement 40 has been changed by the person 30, the headphone circuit 100 sends a feedback signal to the remote control circuit 360 whereby the remote circuit 360 takes a pre-programmed action. Such a pre-programmed action may be, for example, sending a "pause" command to the audio output device 20 upon the second tilt sensor 310 detecting that the headphone arrangement 40 has assumed a horizontal orientation 340 (FIG. 9A), or sending an "off" command to the headphone circuit 100 to turn the audio transducers 50 off to save battery power when the headphone arrangement 40 is in the horizontal orientation 340. Alternately, the pre-programmed action may be sending a "play" command to the audio output device 20 through the control signal transmitter 170 in response to the second tilt sensor 310 detecting that the headphone arrangement 40 has assumed a vertical orientation 350 (FIG. 9B), for example. Such commands may also be sent upon detection of the switch 81 that the remote control 150 has been reengaged with the remote control holder 70 of the headphone arrangement 70. Many of the above commands may also include a command for the remote circuit 360 to turn on or off the display screen 191. For example, when the remote control 150 is reengaged with the remote control holder 70, as determined by the remote sensor 80, the headphone circuit 100 and remote circuit 360 may assume a reduced power-consumption hibernation or standby state with the audio transducers 50 off and the display screen 191 off.

Figure 2A:
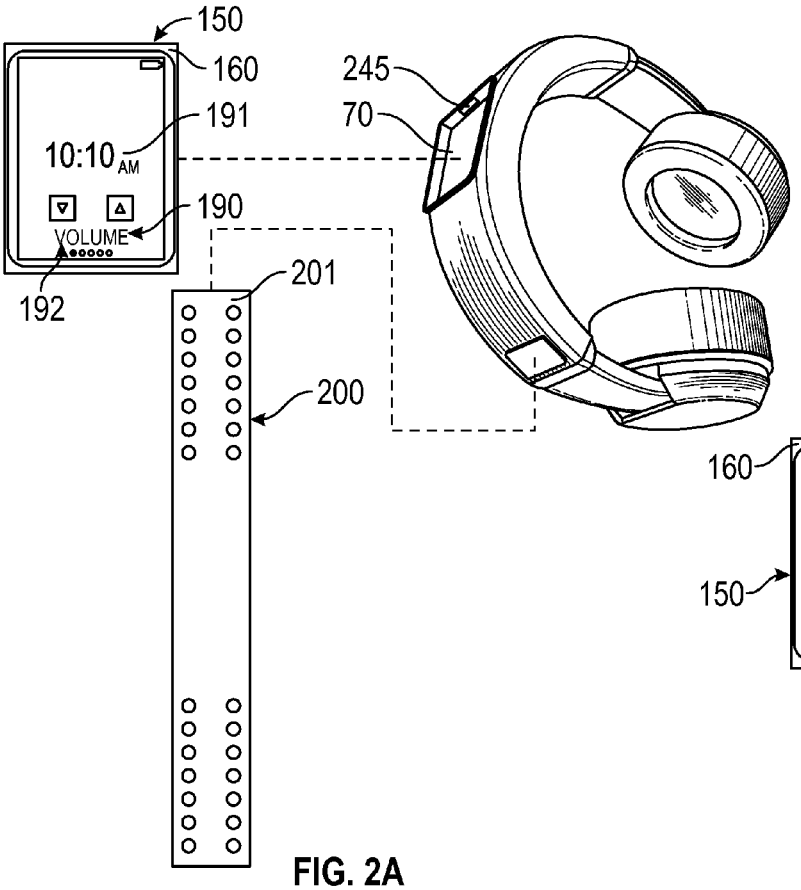
FIG. 2A is a diagram of a removable remote control and a removable personal attachment.
Figure 2B:
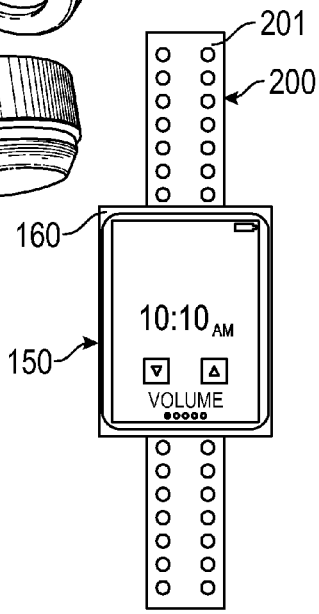
FIG. 2B is a top plan view of the remote control affixed with the personal attachment.
Figure 4B:
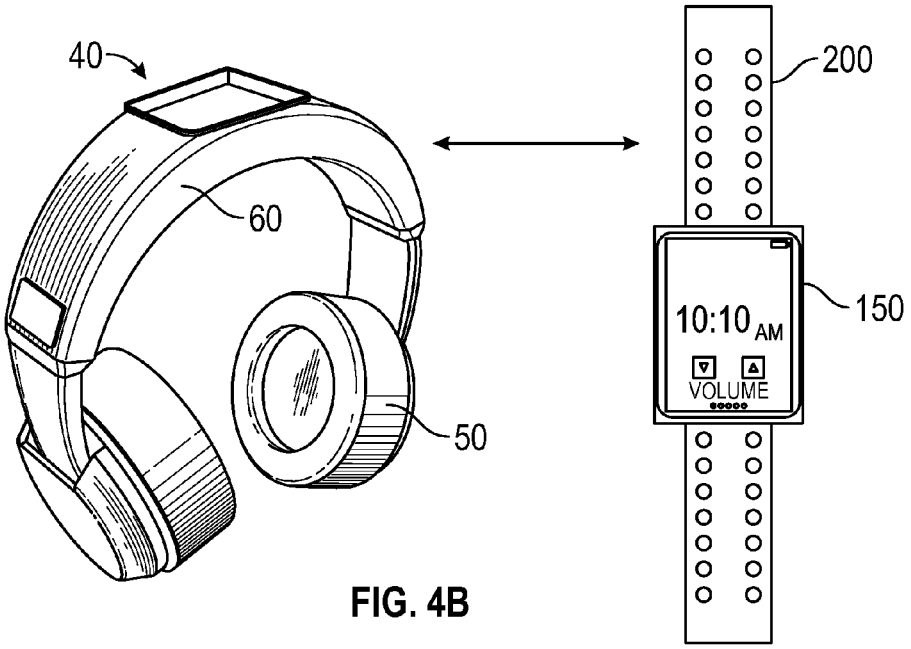
FIG. 4B is a diagram of wireless signal interactions between the headphone arrangement and the remote control.
Figure 4A:
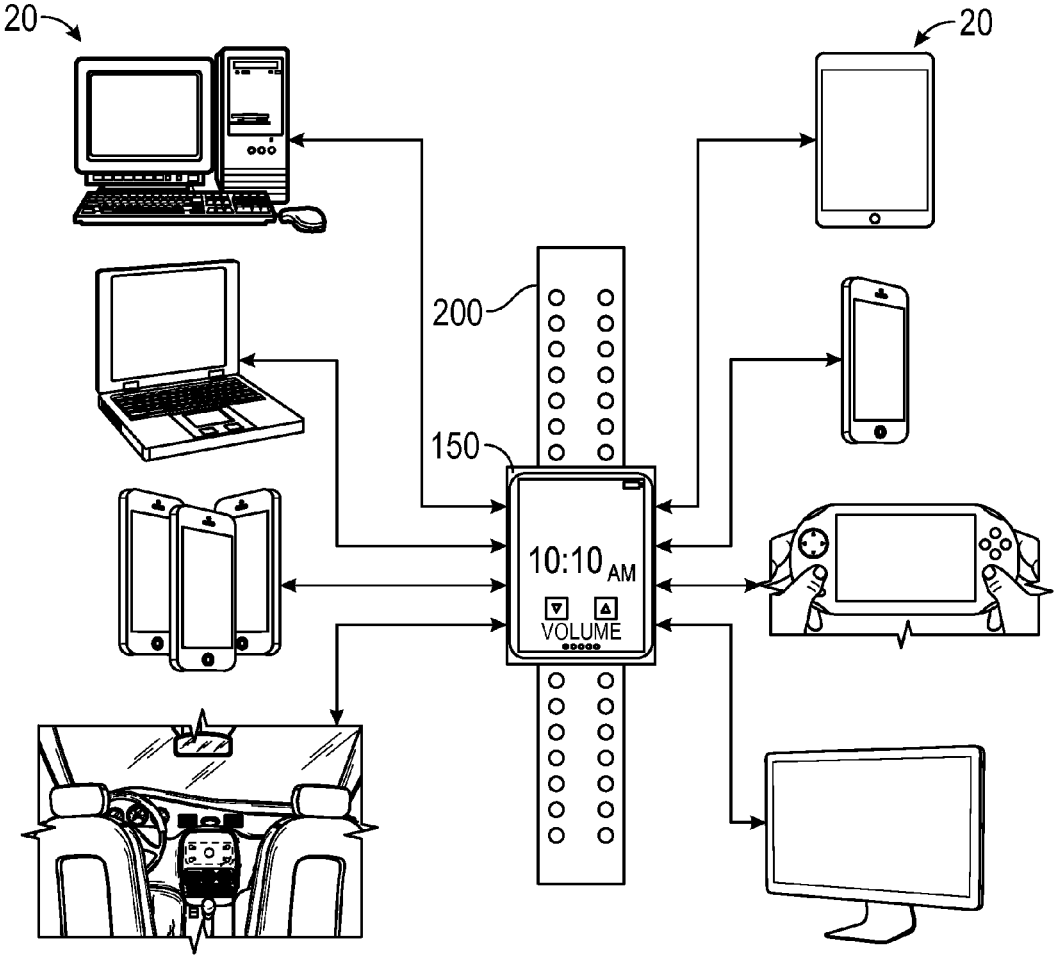
FIG. 4A is a diagram of wireless signal interactions between the remote control and a variety of different audio output devices.
Figure 8A:
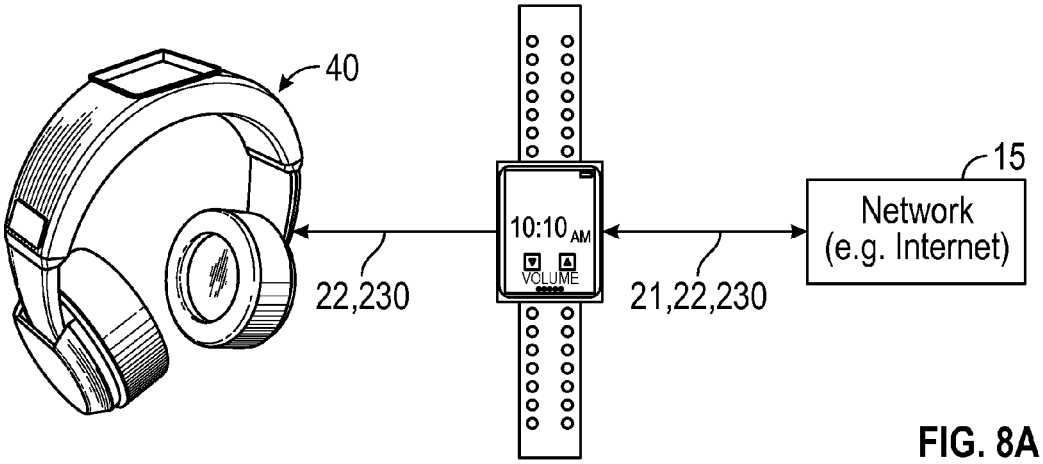
FIG. 8A is a diagram of wireless signal interactions between the headphone arrangement and the remote control, and the remote control and a network.
Figure 8B:
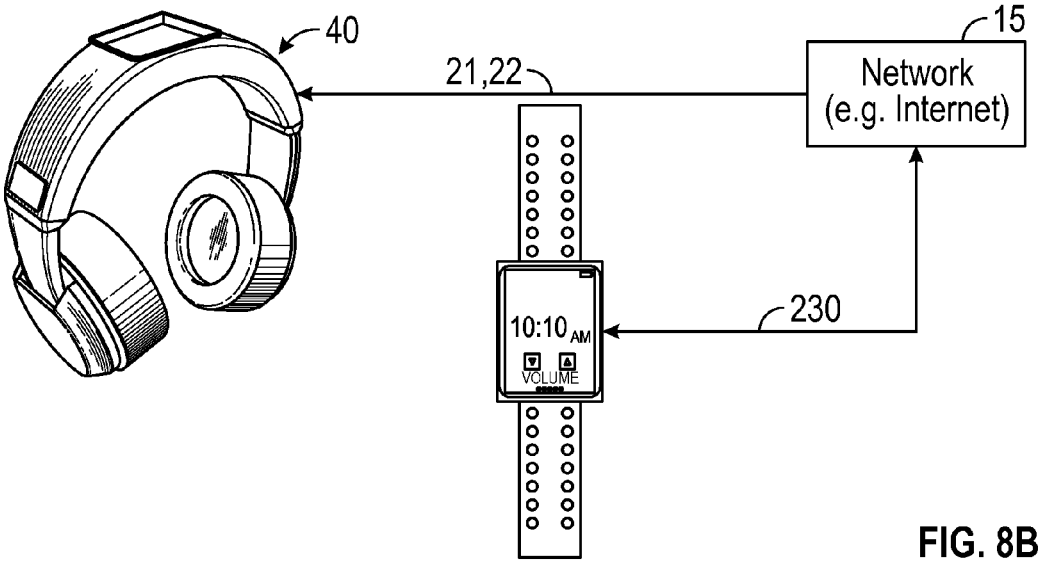
FIG. 8B is a diagram of wireless signal interactions between the headphone arrangement and the network, and the remote control and the network.
Figure 8C:
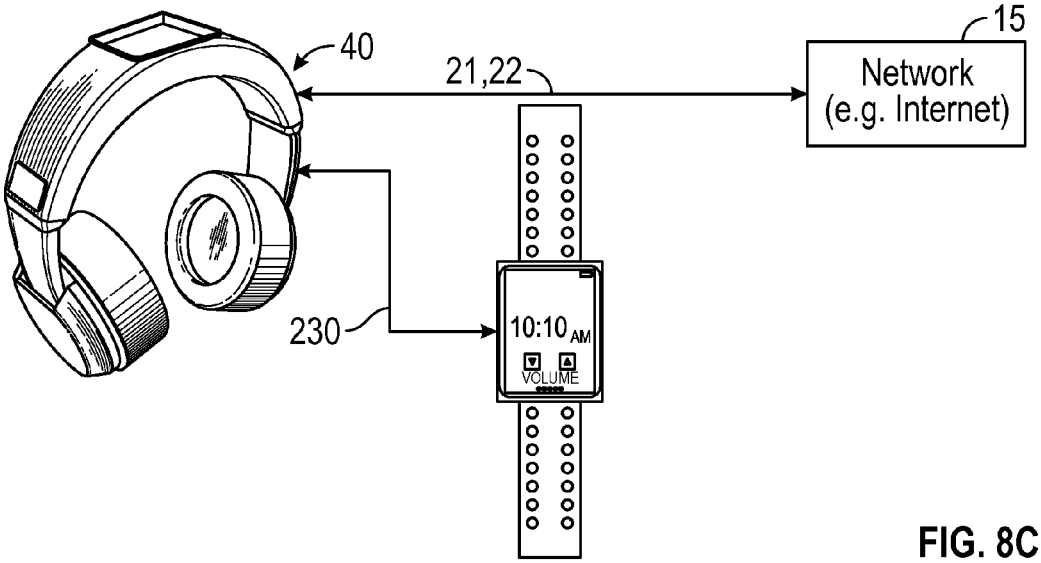
FIG. 8C is a diagram of wireless signal interactions between the headphone arrangement and the network, and the remote control and the headphone arrangement.

In one preferred embodiment, the remote circuit 360 further includes a wireless interface 300 accessible through a wireless communications network 15 (FIG. 8B). The wireless interface 300 in such an embodiment is adapted for loading selected software applications into the memory 290 through the wireless communications network 15, such as a digital clock application, for example (FIG. 2A). The remote circuit 360 further includes an operating system programmed into the memory for controlling the user interface 190. In such an embodiment the wireless audio signal 22 may additionally be received over the remote control 1 150 receives the wireless audio signal 22, modifies it for proper volume, balance, equalization, and the like, and then broadcasts the modified audio signal 22 to the headphone arrangement 40 (FIG. 8A). Alternately, the remote control 150 sends control signals 230 through the network 15 so that the audio output device 20 connected with the network 15 is controlled thereby, the headphone arrangement 40 adapted for receiving the modified audio signal 21 through the network 15 (FIG. 8B). Alternately, the remote control 150 may send control signals 230 to the headphone arrangement 40, which then either modifies the audio signal 21 directly or forwards the control signals 230 to the audio output device 20 through the network 15 (FIG. 8C). In such embodiments the audio output device 15 may be, for example, a remote website or music service delivered over the Internet or through a local WAN or LAN. It is understood that in the embodiments illustrated in FIGS. 8A-8C that the network 15 acts as the audio output device 20, and there may be no physical audio output device 20.

In such an embodiment having the operating system and a microphone 193, and wherein the audio output device 20 includes a telephone function, upon detection of a phone call on the audio output device 20 the remote circuit 360 may display an "answer phone" and "disregard" interface control 192 on the display screen 191. Upon the user 30 actuating the "answer phone" interface control 192, the remote circuit 360 may issue a "pause" command to the audio output device 20 if the audio output device 20 does not already have this feature, and send voice signals back to the audio output device 20 so that the audio playback system 10 acts as a remote Bluetooth-type headset.

The remote control holder 70 is preferably a recess in the top enclosure 60 that includes a remote control release 240 with a remote control catch 245 mechanically operable with the remote control release 240. Upon actuation of the remote control release 240 the remote control catch 245 releases the remote control 150 from the recess. When the remote control 150 is placed back into the remote control holder 70 preferably the remote control 150, remote control release 240 and the top enclosure 60 are substantially flush. Alternately the remote control holder 70 may be a compartment or pocket (not shown) in the top enclosure 60, with or without a hinged or resilient cover (not shown). Alternately, the remote control holder 70 may be a two-part mechanical fastener such as a mechanical snap, hook-and-loop type fastener, or the like (not shown).

A personal attachment 200 is adapted to be fixed with the enclosure 160 of the remote control 150 and, in a worn configuration 210, for attachment with the person 30. In a stowed configuration 220 the personal attachment 200 is fixed with the personal attachment holder 90 of the headphone arrangement 40. The personal attachment 200 may be, for example, a bracelet or wristband 201 that is selectively engageable with the remote control enclosure 160 and storable in the personal attachment holder 90 of the headphone arrangement 40. In one embodiment a second switch 81 (not shown) is fixed with the personal attachment holder 90 for detecting if the personal attachment 200 is present in the personal attachment holder 90, whereby the headphone circuit 100 may take one of a number of pre-programmed actions such as turning the audio transducers 50 on or off, for example. The personal attachment 200 may also be, in alternate embodiments, a slap bracelet, band, strap, armband, or the like (all not shown). In one embodiment, the wristband 201 and remote control enclosure 160 are integrally formed.

Figure 10B:
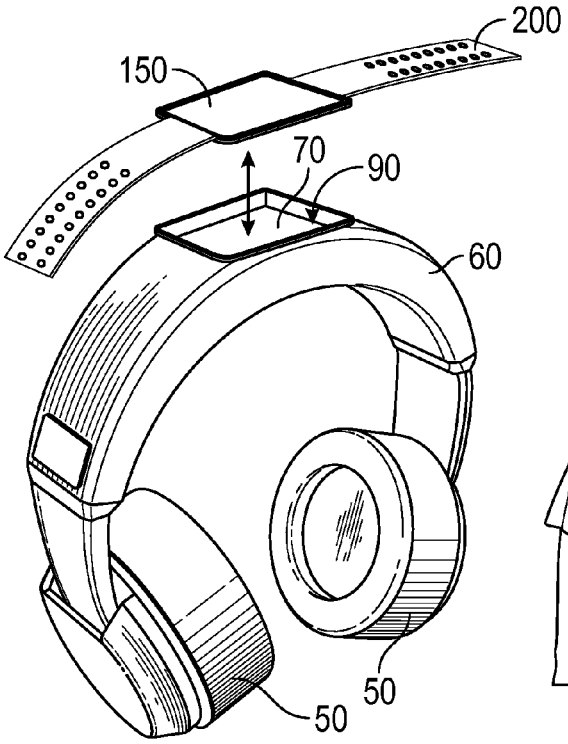
FIG. 10B is an exploded view of FIG. 10A.
Figure 11:
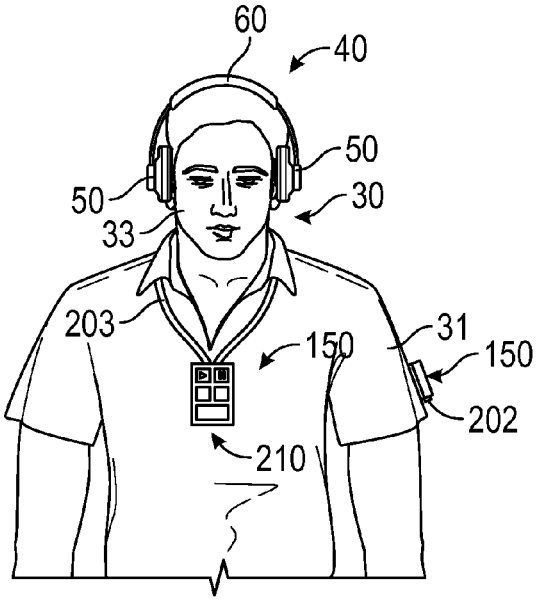
FIG. 11 is a front elevational view of two alternate ways in which a person may wear the remote control.

Alternately, the personal attachment 200 is a mechanical spring-biased clasp 202 (FIG. 11) fixed with the remote control enclosure 160 and adapted to be selectively attached with a garment 31 of the person 30. In such an embodiment, the personal attachment holder 90 and the remote control holder 70 are mutually integrated (FIGS. 10A-10B) and may form a common compartment in the top enclosure 60 of the headphone arrangement 40. In yet another embodiment, the personal attachment 200 is a necklace 203 selectively fixed with the remote control enclosure 160 and adapted for selective attachment about the neck 32 of the person. The necklace 203 may be stored in the personal attachment holder 90 separate from the remote control 150, or fixed therewith in an embodiment having a combined personal attachment holder 90 and remote control holder 70.

In use, the person 30 detaches the remote control 150 from the remote control holder 70, and the personal attachment 200 from the personal attachment holder 90 and affixes the remote control 150 to the personal attachment 200, if necessary. The person 30 then wears the personal attachment 200. Control signals 230 are transmitted to the control signal input 130 of the headphone arrangement 40 by the control signal transmitter 170 in response to the person 30 interacting with the user interface 190. The headphone circuit 100 alters the audio output of the headphone circuit 100 in accordance thereto. When the person 30 is finished listening to the audio output the personal attachment 200 and the remote control 150 are stowed in the headphone arrangement 40, whereby the headphone circuit 100 is deactivated by the remote sensor 80.

In one embodiment of the invention, the headphone circuit 100 further includes one of the microphones 193 (FIG. 9A) and the feedback transmitter 320, and the remote circuit 360 further includes one of the feedback signal receivers 330. As such, the remote circuit 360 is adapted for receiving a headphone audio signal from the microphone 193 through the headphone circuit 100 and feedback transmitter 320. Either alternately or in addition, the headphone circuit 100 further includes one of the cameras 194 (FIG. 9B), such that the remote circuit 360 is adapted for receiving a video signal from the camera 194 through the headphone circuit 100 and feedback transmitter 320.

Figure 7:
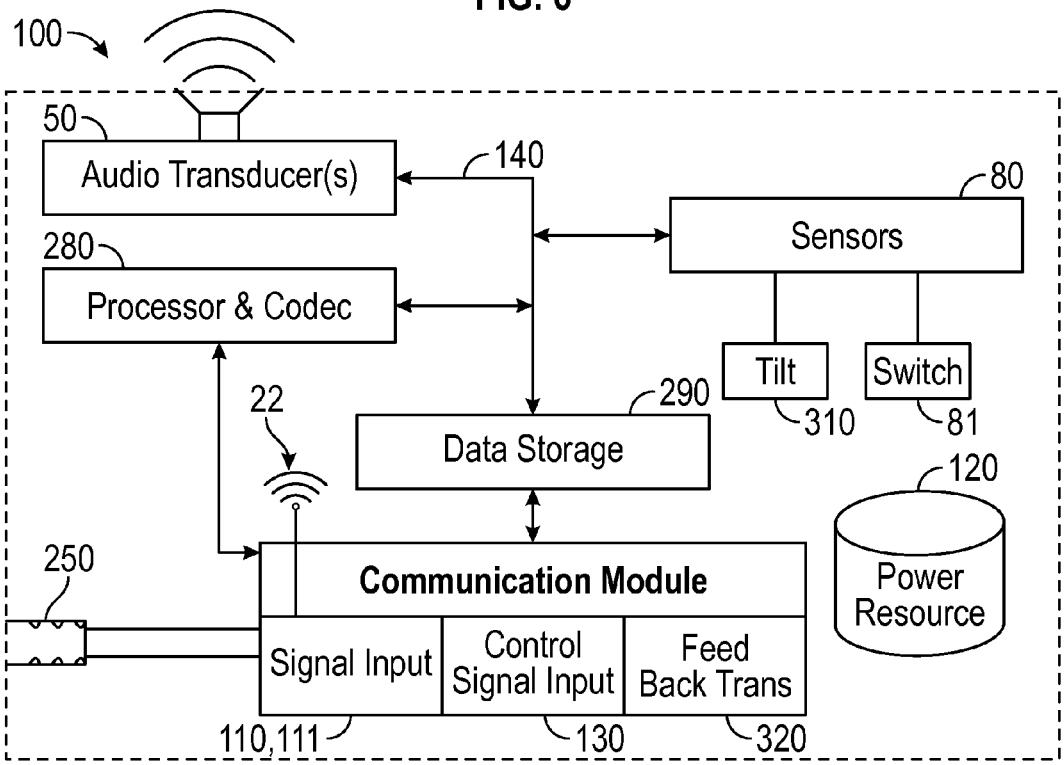
FIG. 7 is a block diagram of the functional attributes of a headphone circuit of the headphone arrangement.

In one embodiment, the headphone circuit 100 further includes one of the processors 280 and memory 290 (FIG. 7) and is adapted to decompress a compressed audio signal 21 or compressed wireless audio signal 22, or to decode an encoded audio signal 21 or encoded wireless audio signal 22.

While a particular form of the invention has been illustrated and described, it will be apparent that various modifications can be made without departing from the spirit and scope of the invention. For example, multiple headphone arrangements 40 or other audio transducers 40 such as speakers, earphones, ear-buds, and the like, may be included for receiving the control signals 230 from the remote control 150, wherein a master headphone arrangement 40 includes the remote control 150 and each additional headphone arrangement 40 does not include the remote control holder 70 but is rather designated a "slave" headphones (not shown). Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

Additional Information and Embodiments

The following description may use different terms for components listed above. The invention may include the following elements or features:

Components to Audio Transducer Apparatus:

An Audio Transducer Apparatus possessing at least one digital display device, and strap, band, bracelet, or clasp attached separately to at least one Audio Transducer apparatus. Once removed, the digital display device can be fashioned to at least one strap, band, bracelet, or clasp and worn by the user in a plurality of convenient locations. The digital display device is pre-configured to communicate with the associated audio transducer apparatus.

Non-Touch Smart-Connected-Device Convenience:

The Art enables the user to leave their 'smart-connected-device' say in their pocket or purse, on the table, or on a docking station charging its battery all the way across the room, while all forms of communication being received by the 'smart-connected-device' are being transferred (pushed) to the digital display device, and where the user can still interact (receive/send) such forms of content. As such, the Art provides convenience to users who still want or need to be connected to the world, but might not want to be interrupted all the time.

Digital Display Materials:

The digital display device may possess at least one type of digital display, such as LCD, LED, OLED, or other technology for providing visual data and information, both input and outputs.

Can be Used in-Line Wired or Wireless:

The Audio Transducer apparatus can be connected in-line wired or wireless means to at least one electronic device, such as a 'smart-connected-device' such as a desktop computer, laptop, notebook, netbook, tablet PC, smart phone, portable media player, game player, game station, TV, TV console, home or vehicle entertainment systems, stereo systems, and the like.

Variable Wireless Standards can be Configured:

The digital display device is easily be configured to communicate with at least one electronic device, such as a 'smart-connected-device', by various industry standards such as; Wi-Fi, Hi-Fi, Wi-Max, WAP, Bluetooth, NFC, WAP, 3G, 4G, 5G, 6G, or any other wireless frequency spectrum or split spectrums, providing all forms of data information between a 'smart-connected-device, a digital display device, and the Audio Transducer Apparatus.

Variable Input Capabilities:

The digital display device can be configured to provide the user touch-sensitive capabilities, as well as voice recognition, speech enabled navigation, speech menu scrolling, voice-print recognition, language processing, vibration, illumination, motion, pre-touch or a motion sensor, proximity, angel-degree identification, and other forms of interactive techniques.

Open Source—App Store:

The digital display device possessing an open source OS, operating system, where users can download software applications from at least one (App Store) enabling the digital display device to communicate with and control unlimited types of electronic devices, both local and remote and well as all forms of content directly to the digital display device.

Directly Connecting to a Wireless Network:

The digital display device can be configured to communicate with at least one type of wireless network, such as a wireless router, for providing all types of communication to and from the device, rather than solely through a configured electronic device, such as a 'smart-connected-device' to the Audio Transducer Apparatus.

Providing all Forms of Social Media on the Digital Display Device:

The digital display device can be configured to provide all forms of Social Media, such as (Facebook, Twitter, Tumblr, Instragram, U-tube, Line, Linkedin), RSS feeds, email notifications, and Messenger functions to the user whether from a local electronic device (such as a smartphone, tabletPC, laptop, TV, or alike), direct network connection configuration, or the like.

Configurable to a Plurality of Devices:

The digital display device can be configured to more than one speaker or device possessing speakers, simultaneously providing audible data and information to a plurality of devices. The digital display device can be configured by users to share the same audible files simultaneously to a plurality of Audio Transducer Apparatus devices.

Cloud Direct to Digital Display and Audio Transducer Apparatus:

The digital display device can be configured for users to receive data and information from the 'Cloud', such as Apple iTunes Radio, Spotify, Pandora, Google Music All Access, Amazon Music, Nokia Music, RedBox, Sirius Radio, or other services for Music, Movies, Books, RSS feeds, or alike to its Audio Transducer Apparatus. The User either plugs their 'smart-connected-device' by wired means to the Audio Transducer, acquires audio content through their 'smart-connected-device', by remote Cloud network configuration through the 'smart-connected-device or directly through the digital display device.

Sensor #1: The Audio Transducer Apparatus possesses at least one 'sensor' for detecting when the digital display device is removed, thus automatically triggering one of many variable User Preferences such as; Automatically turn ON the headphones and digital display device. Likewise, when the digital display device is attached back to the Audio Transducer Apparatus, User Preferences can elect to turn the device OFF, Pause any music playing, Stop, FF, RW, Skip, Sleep, Hibernate, take a call, hang up on a call, or other user selection. In this case, there is no need for a physical On/Off button to the Audio Transducer Apparatus or digital display device. The User can listen to Music by wired means between the headphone device and a 'smart-connected-device' without removing the digital display device. The headphone device or Audio Transducer Apparatus possesses a sensor comprised part of the in-line wire that detects when the in-line wire is inserted into a 'smart-connected-device' and automatically turns On, if it requires internal power resources to the headphone device.

Sensor #2: Audio Transducer Apparatus possesses at least one sensor for detecting when the user sets the apparatus down, automatically triggering variable User Preference Actions, such as; Turn Off the device, Sleep, Hibernate, Pause or Stop Music or Movie, hang up a Call, or other user selection. Variable selections can be configured by the user for when they pick back up the Audio Transducer Apparatus, such as start playing music or movie again, hang-up or answer a Call, Turn back On, or other user selection.

Camera/Video Capabilities:

Audio Transducer Apparatus possesses at least one 'microphone', 'speaker', 'camera' for providing photo, video capabilities. The digital display device possesses user remote control functions and inputs through a GUI, graphic user interface, enabling the user to take photos and video and immediately post on (say) Instrgram, Facebook, Tumblr, email, or other, or Video immediately on (say) U-tube, Facebook, other Social Media platforms, email, online or off-line platforms.

Sensor #3: The digital display device possesses at least one sensor for detecting when the digital display device is rotated (vertical to horizontal) or visa-a-versa, thus automatically triggering one of many variable User Preferences such as; Automatically turn ON/OFF the headphones and/or digital display device, Pause any music playing, Stop, FF, RW, Skip, Sleep, Hibernate, take a Call, hang up on a call, or other user selection. In this case, there is no need for a physical On/Off button.

Description of Wired or Wireless Networks:

The Audio Transducer Apparatus may communicate with a network (e.g. internet) and/or a communication server via network connection directly through its digital display device, or through at least one electronic device, such as a 'smart-connected-device to a local and/or remote network. The network may be also used for communication among various components of a system for accessing media and performing communications for the audio transducer and digital display device. The media data may include cloud data and information such as; music, video on demand data, social media, network data, and so forth. The network may include the Internet or any other network capable of communicating data between the audio transducer and digital display device. Suitable networks may include or interface with any one or more of, for instance, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, Digital Data Service (DDS) connection, DSL (Digital Subscriber Line) connection, an Ethernet connection, an ISDN (Integrated Services Digital Network) line, a dial-up port such as a V.90, V.34 or V.34bis analog modem connection, a cable modem, or an FDDI (Fiber Distributed Data Inter face) or CDDI (Copper Distributed Data Interface) connection. Furthermore, communications may also include links to any of a variety of Wireless networks, including WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS (Global Positioning System), CDPD (cellular digital packet data), RIM (Research in Motion, Limited) duplex paging network, Bluetooth radio, or an IEEE 802.11-based radio frequency network. The network can further include or interface With any one or more of an RS-232 serial connection, an IEEE-1394 (FireWire) connection, a Fiber Channel connection, an IrDA (infrared) port, a SCSI (Small Computer Systems Interface) connection, a USB connection or other Wired or Wireless, digital or analog interface or connection, mesh, or Digit networking. The network may include any suitable number and type of devices (e.g., routers and switches) for forwarding commands, content, and/or requests for each user to their audio transducer. The audio transducer may communicate with the GPS satellite via the network to exchange data on a geographical location of the device. Additionally, the audio transducer may communicate with mobile network operators using a mobile base station.

The methods described herein may also be practiced in a wide variety of network environments including, for example, TCP/IP-based net works, telecommunications networks, wireless networks, etc. In addition, the computer program instructions may be stored in any type of audio transponder device. The program may be executed according to a variety of computing models including a client/server model, a peer-to-peer model, on a standalone computing device, or according to a distributed computing model in which various functionalities described herein may be affected or employed at different locations. The audio transducer may connect to the one or more external devices. An external device may include a television set, a set-top box, a computer, a laptop, tablet PC, a smart phone, a 'smart-connected-device', and so forth. The audio transducer may connect to the one or more external devices wirelessly or by in-line wires using various connections such as a USB port, a parallel port, an infrared transceiver port, a radiofrequency transceiver port, and so forth.

The audio transducer may be controlled using one or several external devices. For example, a user may run an application on their smart phone and control the operation of the audio transducer via the smart phone device, rather than the audio transducer devices digital display device.

For the purposes of communication, the audio transducer may be compatible with one or more of the following network standards: GSM, CDMA, LTE, Wi-Max, IMS, Universal Mobile Telecommunication System (UMTS), 4G, 5G, 6G and upper, RFID, and so forth.

Detailed description of FIGS. 12-22, in which numbered elements above may be renumbered for specific reference below, follow.

Figure 12A:
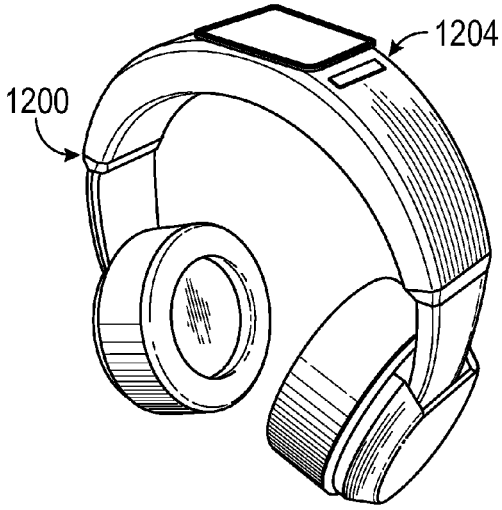
FIG. 12A is a left perspective view of one embodiment of the invention.
Figure 12B:
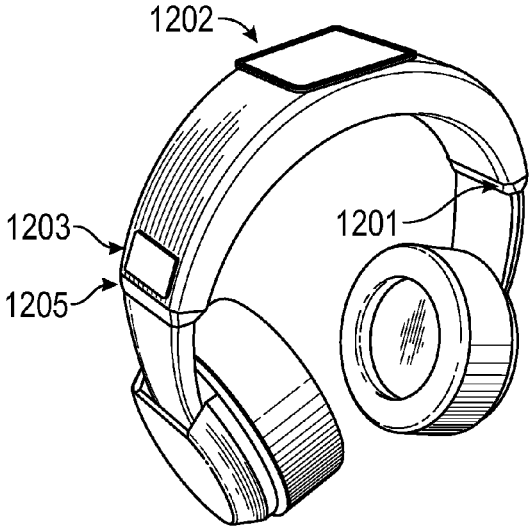
FIG. 12B is a right perspective view of FIG. 12A, showing a headphone arrangement of the invention.

FIGS. 12A and 12B illustrate an arrangement 1200 of audio transducer. Arrangement 1200 includes a headphone apparatus 1201 that is able to receive media input for a user from a digital display 1202 device or directly from an electronic device, such as a 'smart-connected-device' or portable media player that can store and retrieve data. The digital display 1202 device releases from the headphone apparatus 1201 from a release button 1204 fashioned to the headphone apparatus 1201. A hinged accessible hatch 1203 is integrated into the headphone apparatus 1201 for storage and retrieval of a strap, bracelet, band 1205 or other means of conveniently enabling the user to wear the digital display device 1202. Separate storage locations for the digital display device 1202 and the strap, bracelet, band 1205 provides for a plurality convenient storage design configurations. The audio transducer 1200 can be in-line wired or wireless for communication to any type of electronic device providing audio capabilities. The associated hatch cover 1203 can also possess a sensor for detecting when opened and closed as well as the existence of at least one the strap, bracelet, band, clasp, or other 105 device being stored within the headphone apparatus 1201.

The user could theoretically store a plurality of these accessories on a headphone apparatus 1201. Accessories can be of any design, configuration, shape, materials, and may possess other attributes besides (wearability) feature alone.

Figure 13:
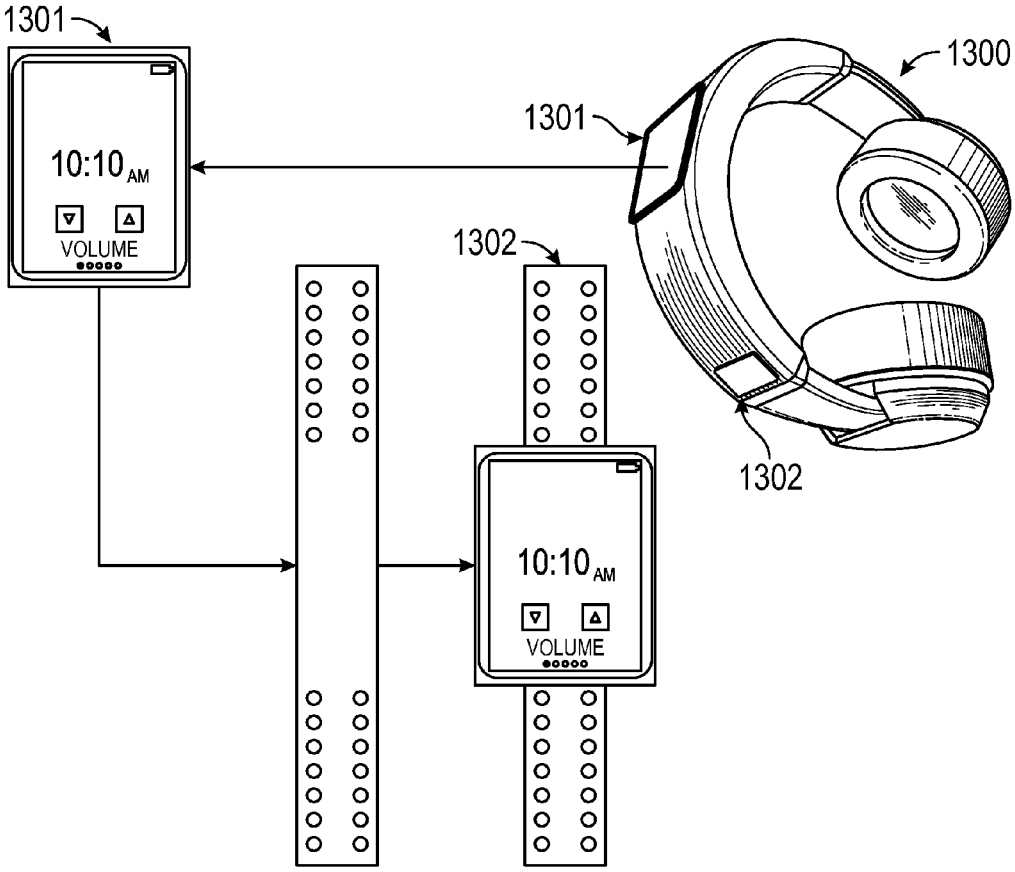
FIG. 13 is a diagram of a removable remote control and a removable personal attachment.

FIG. 13 is an illustration of an arrangement 1300 of audio transducer. Arrangement 1300 includes a headphone apparatus 1300 that is able to receive media input for a user from a digital display 1301 device or directly from an electronic device, such as a 'smart-connected-device' or portable media player that can store and retrieve data. Once the user removes the digital display 1301 device from the headphone apparatus 1300, a sensor (not shown) detects and automatically turns the digital display 1301 device as well as the headphone apparatus 1300 ON for the user. Once the user removes the digital display 1301 device and the strap, bracelet, band 1302 from the headphone apparatus 1300, the user connects the digital display 1301 device and strap, bracelet, band 1302 device together to be worn in a comfortable location. The same holds true when the user returns the digital display 1301 device to the headphone apparatus 1300 where the headphones apparatus 1300 and digital display 1301 device turns OFF automatically for the user.

User Preferences exist within the Graphic User Interface, GUI, of the digital display 1301 device, or can be downloaded by the user onto to their electronic device, such as a 'smart-connected-device' (not shown), that allows the user to configure various actions, (On, Off, sleep, hibernate, pause or play music, answer or hang up a call, and more), based upon removal or attachment of the digital display 1301 device and the strap, bracelet, band 1302 device with the headphone apparatus 1300.

With this type of design configuration, the headphone apparatus 1300 does not require a physical On/Off button. Only when a user utilizes the headphone apparatus 1300 would the headphone automatically be turned On for the user. The same holds true for the digital display 1301 device. Only when the user removes the digital display 1301 device from the headphone apparatus 1300 would power resources be required, and if there exists a time when the user wishes to utilize the digital display 1301 device without removing it from the headphone apparatus 1300, user preferences are provided to the user on the digital display 1301 device or an electronic device, such as a 'smart-connected-device' (not shown), to configure different user settings quickly and easily.

Although FIG. 13 illustrates the digital display 1301 device and at least one type of strap, bracelet, band, clasp 1302 device are stored in different locations on the audio transducer apparatus 1300, other designs include combined digital display 1301 device and strap, bracelet, band 1302 device as a single attached, removable and wearable apparatus to the art.

Figures 14A, 14B:
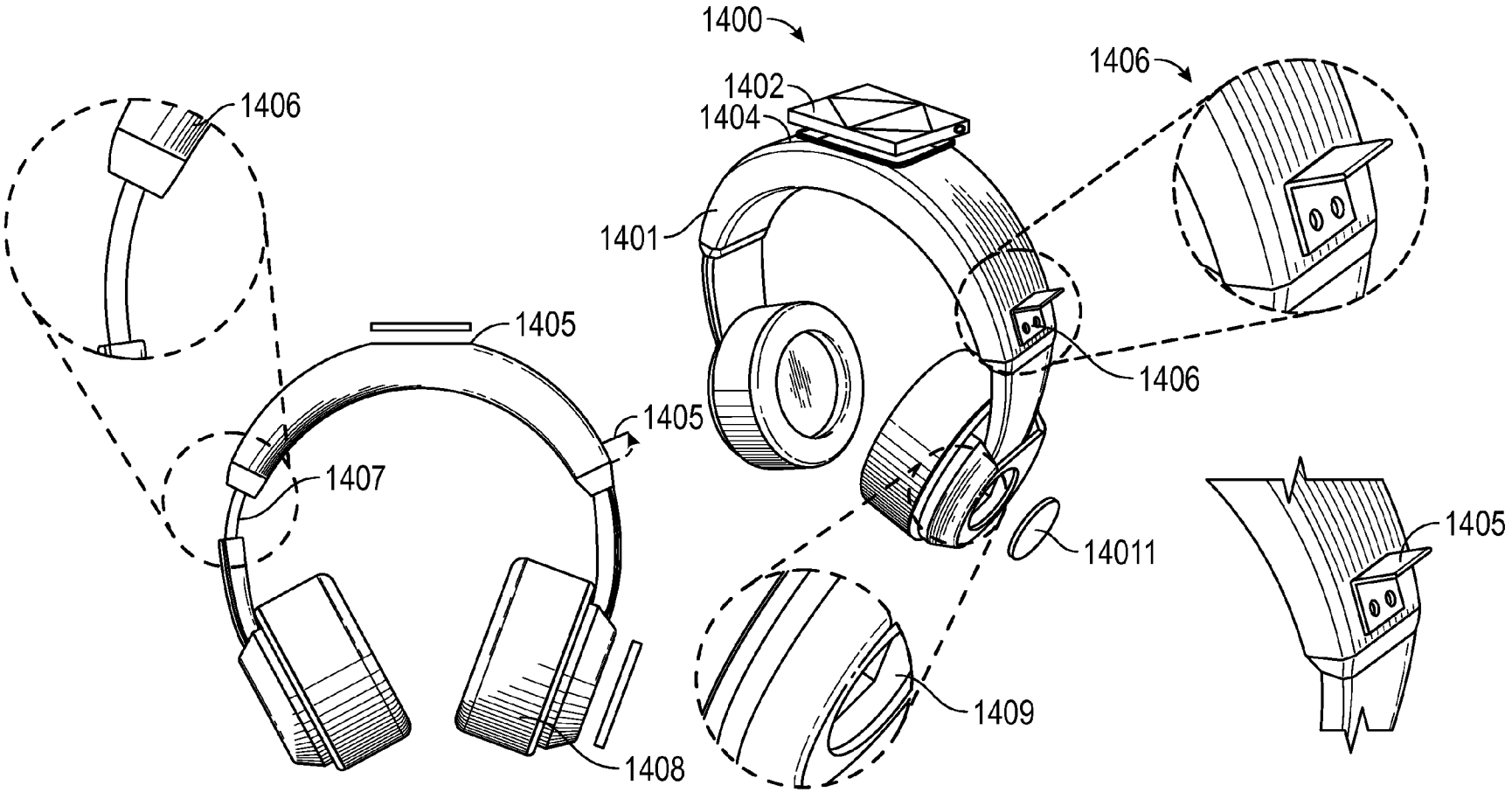
FIG. 14A is a front elevational view of an alternate embodiment of the invention.
FIG. 14B is a perspective view of a FIG. 14A.

FIG. 14 is an illustration of an arrangement 1400 of audio headphone apparatus.

Arrangement 1400 includes a main headphone apparatus 1401 possessing a headphone device 1401, an attached digital display device 1402, held in the pocket or docking station 1403 of the headphone device, and removable from the headphone device 1401 from its fashioned release button 1404 from its docking station 1403. The headphone device 1401 possesses an incorporated hinged hatch with snap closure 1405 enabling the user to conveniently store, remove, and slide in at least one type of band, bracelet, strap, 1406 or alike, or other accessory item. The headphone device 1401 possesses telescope type adjustments 1407, tilt lower assembly 1408, and stainless steel pivot pins 1409 for the ear-cups and speaker drivers 1410 to conveniently fit on any sized head. The headphone device 1401 has a removable component 1411 to easy access inside to where power resources, electronics, and other components (not shown) can more easily be accessible.

This arrangement 1400 shows that when the user removes digital display device 1402 by utilizing the fashioned release button 1404 to release the digital display device 1402 from its docking station 1403, an incorporated sensor (not shown) to the digital display device 1402 and headphone device 1401 can automatically trigger these devices to be turned On, thus the digital display device 1402 and headphone device 1401 does not require any type of physical On/Off button. The same holds true when the user returns the digital display device 1402 to the headphone device 1401, default configuration can automatically turn the digital display device 1402 and headphone device 1401 Off, or other user preferences such as; sleep, hibernate, and alike.

This function can also be incorporated for a variety of accessories that are stored, removed, and replaced to the headphone apparatus 1400, through at least one type of sensor the is triggered from the opening and closing of the hinged hatch with snap closure 1405.

Figure 15A:
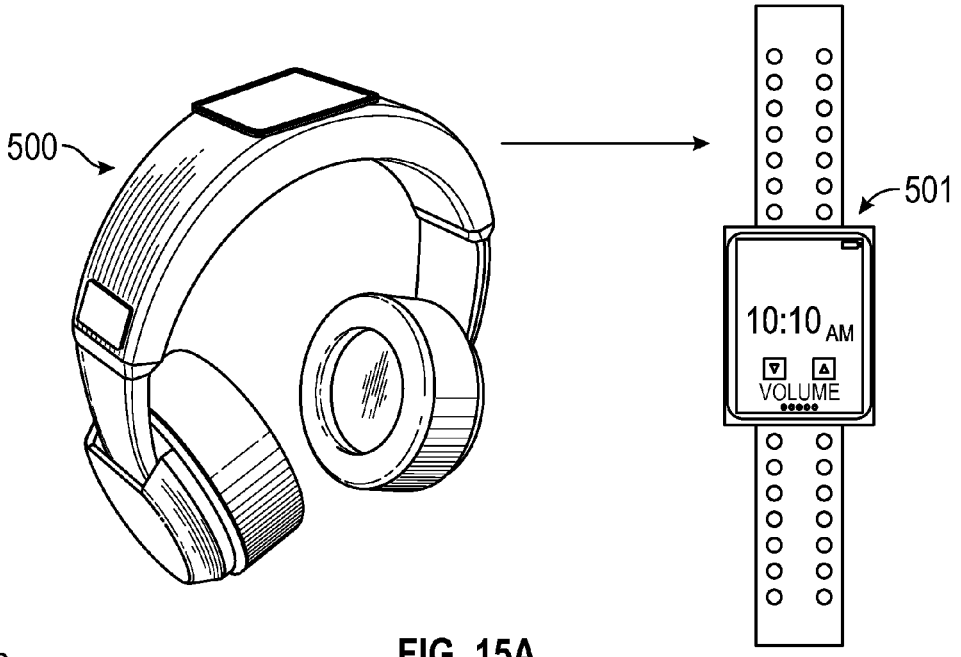
FIG. 15A is a diagram of wireless signal interactions between the headphone arrangement.
Figure 15B:
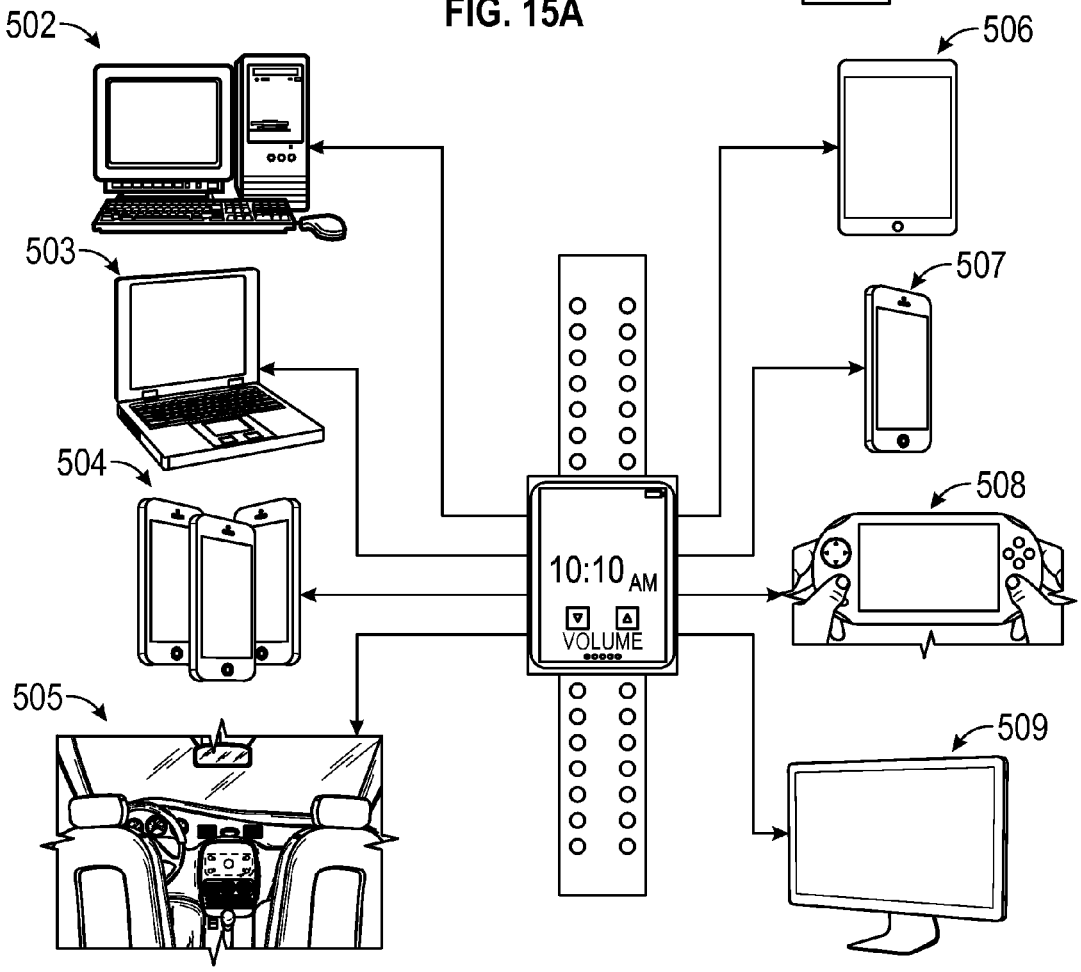
FIG. 15B is a diagram of the remote control interacting with a variety of different audio output devices.

FIGS. 15A-B illustrate an arrangement 500 of audio transducer. Arrangement 500 includes a headphone apparatus 500 that is able to receive media input for a user from a plurality of electronic devices, such as a 'smart-connected-device', a desktop computer 502, laptop 503, notebook, netbook, tablet PC 506, smart phone 504, portable media player 507, game player 508, game station, TV 509, TV console, home or vehicle entertainment systems 505 and stereo systems to name a few, that can store and retrieve data directly to the headphone apparatus 500 or to the digital display device 501 which encodes and transmits media to the headphone apparatus 500.

Arrangement 500 the digital display 501 device is interoperable and scalable in design and can also be configured to communicate and control a plurality of electronic devices by the user simply by downloading software applications from an (app store), directly by wired or wireless network configurations to the digital display 501 device, or first through any type of connected device, such as a 'smart-connected-device', to the digital display 501 device, which facilitates such configurations, and is not limited in its design to solely provide remote control functions to the headphone apparatus alone.

The digital display 501 device then becomes more convenient and useful to a user as it will conveniently control more and more of a users electronic devices around their daily lives, rather than solely remote control functions with the headphone apparatus 500 or 'smart-connected-devices' alone.

Figure 16A:
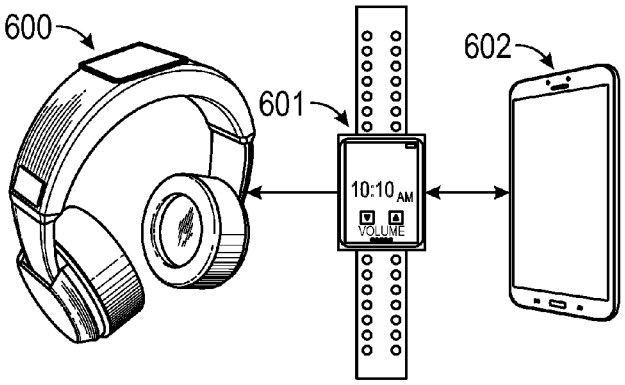
FIG. 16A is a diagram of wireless signal interactions between the headphone arrangement and the remote control, and the remote control and a so-called "smart phone" audio output device.
Figure 16B:
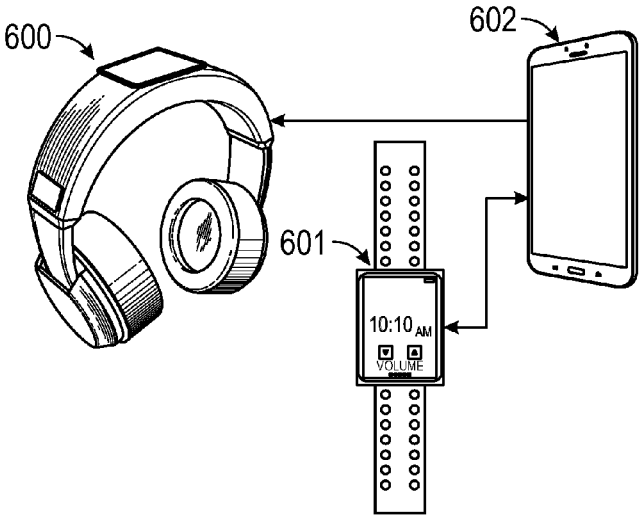
FIG. 16B is a diagram of wireless signal interactions between the headphone arrangement and the audio output device, and the remote control and the audio output device.

FIGS. 16A-B illustrate an arrangement 600 of an audio transducer.

Arrangement FIG. 16A includes a headphone apparatus 600, a digital display 601 device, and at least one electronic devices, such as a 'smart-connected-device' 602. FIG. 16A illustrates communications between the digital display 601 device and at least one electronic devices, such as a 'smart-connected-device' 602, (such as a smart phone), where data and information and sent and received between the devices. In this design configuration, the digital display device 601 receives media input from an electronic devices (which may be encoded, compressed, and alike), such as a 'smart-connected-device' 602, and sends the media to the headphone apparatus 600 which decodes, (in some cases decompresses), and plays the audio content. Arrangement FIG. 16A, the headphone apparatus 600 would possess at least one processor, microprocessor, RAM, ROM, Cache, CODEC, speakers, microphone, camera, sensor, communications module, power resources, and alike.

In the first preferred embodiment to FIG. 16A, the electronic devices, such as a 'smart-connected-device' 602, controls encoding and compression quality and techniques sent to the digital display 601 device and transmitted to the headphone apparatus 600 which decompresses and decodes the wireless streaming media content for user listening.

In the second preferred embodiment to FIG. 16A, the electronic devices, such as a 'smart-connected-device' 602, sends any type or format of wireless streaming media content to the digital display 601 device which controls encoding and compression quality and techniques which is sent to the headphone apparatus 600 that decompresses and decodes the wireless streaming media content for user listening.

In the third preferred embodiment to FIG. 16A, the electronic devices, such as a 'smart-connected-device' 602, sends any type or format of wireless streaming media content to the digital display 601 device which encodes the wireless streaming media and sends it to the headphone apparatus 600 which decodes and plays the wireless streaming media content for user listening.

Arrangement FIG. 16B includes a headphone apparatus 600, a digital display 601 device, and at least one electronic devices, such as a 'smart-connected-device' 602. FIG. 16B illustrates communication and remote control functions by the digital display 601 device are between the electronic devices, such as a 'smart-connected-device' 602. The electronic devices, such as a 'smart-connected-device' 602 directly sends streaming media to the headphone 600 device for user listening.

In the first preferred embodiment to FIG. 16B, the electronic devices, such as a 'smart-connected-device' 602 controls encoding and compression quality and techniques related to the wireless streaming media and sends it directly the headphone apparatus 600 which decodes, decompresses, and plays the wireless streaming media content for user listening. Arrangement FIG. 16B, the headphone apparatus 600 would possess at least one processor, microprocessor, RAM, ROM, Cache, CODEC, speakers, microphone, camera, sensor, communications module, power resources, and alike.

At least one sensor is included in to top front portion of headphone padding, utilized to detect and trigger pre-programmed features for the user, such as turning the headphone device into sleep or hibernation mode thus saving power resources, detecting when the user set down the headphones on the table or surface. There can also be one sensor each in the ear-cups used for detecting when the user takes the headphones off their heads, but keeps them on their neck and resting on their chest. Sensors detect such occurrence automatically take the headphones into sleep, hibernate or power saving mode.

In this design configuration, the digital display 601 device functions are reduced to that of solely remote control user functions, selections or 'inputs', but does not take part in the encoding/decoding, compression/decompression and wireless transmission of streaming media to the headphone 600 for user listening.

Figure 17:
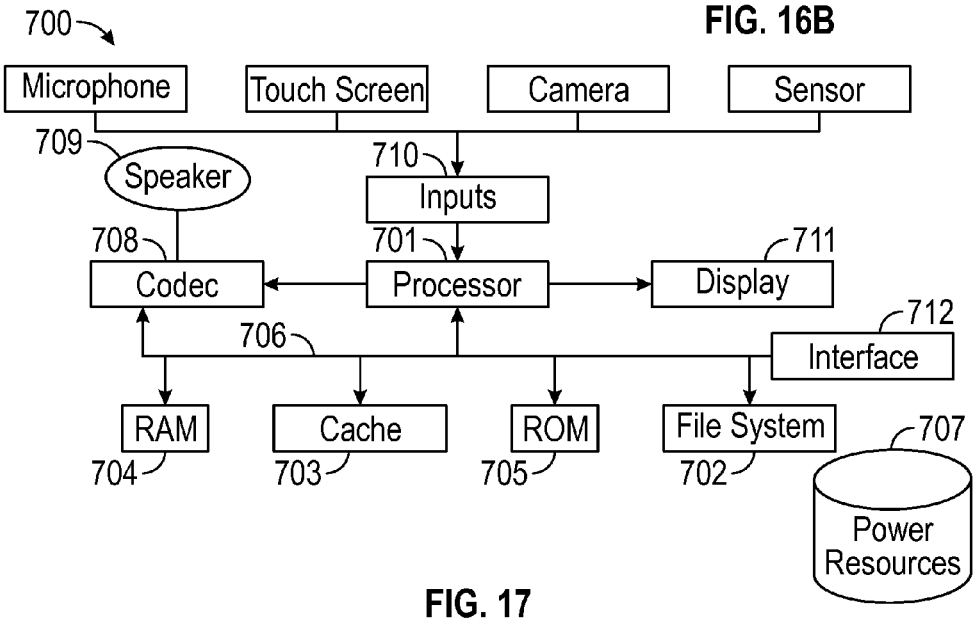
FIG. 17 is a block diagram of the functional attributes of one embodiment of a remote control circuit of the remote control.

FIG. 17 is a block diagram of an attached, removable and wearable digital display device 700 to the audio transducer suitable for use with the described embodiments. Electronic device 700 illustrates circuitry of a representative digital display device. Electronic device 700 includes a processor 701 that pertains to a microprocessor or controller for controlling the overall operation of the electronic device 700. Electronic device 700 stores media data pertaining to media items in a file system 702 and a cache 703. The file system 702 is, typically, a storage disk or a plurality of disks. The file system 702 typically provides high capacity storage capability for the electronic device 700. However, since the access time to the file system 703 is relatively slow, the electronic device 700 can also include a cache 703. The cache 703 is, for example, Random-Access Memory (RAM) provided by semiconductor memory. The relative access time to the cache 703 is substantially shorter than for the file system 702. However, the cache 703 does not have the large storage capacity of the file system 702. Further, the file system 702, when active, consumes more power than does the cache 703. The power consumption is often a concern when the electronic device 700 is a portable media device that is powered by a battery 707. The electronic device 700 can also include RAM 704 and Read-Only Memory (ROM) 705. The ROM 705 can store programs, utilities or processes to be executed in a non-volatile manner. The RAM 704 provides volatile data storage, such as for the cache 703. The electronic device 700 also includes a user input device 710 that allows a user of the electronic device 700 to interact with the electronic device 700. For example, the user input device 710 can take a variety of forms, such as a touch screen, audio input interface, visual/image capture input interface, input in the form of sensor data, etc. Still further, the electronic device 700 includes a display 711 (screen display) that can be controlled by the processor 701 to display information to the user. A data bus 706 can facilitate data transfer between at least the file system 702, the cache 703, the processor 701, and the CODEC 708.

In one method of the system, the smart phone user downloads an App onto their smart phone that controls the CODEC 708 and audio quality, plus provides user with GUI, the audio signal is sent to the headphones 709, when the audio signal is received by the headphones 709, the headphones CODEC 708 converts the sound to provide HD quality surround sound. Audio files are sent in HD bitstream to the headphones 709 to retain the highest quality surround sound possible for the user.

In another method, the device 700 can receive Bluetooth, convert with embedded Processor and firmware with CODEC 708 to improve sound quality, before sending it to the headphones 709 via high quality HD bitstream. This HD bitstream is full HD quality surround sound (full HD quality), not Bluetooth (at lower quality because it encodes and compresses sound quality, then decompressed and decodes sound one hears).

In another method, the device 700 can also take audio files from a wireless network or smart phone using the embedded CODEC 708 within the digital display 700 in HD bitstream quality and send it to the headphones 709 for decoding and post-processing to enhance sound quality (no data compression/decompression used like with Bluetooth methods that distort and reduce sound quality).

The headphones 709 are thus calibrated where reference data is decoded and post-processing enhancement is employed to deliver home theater-quality surround sound experience over the headphones 709.

Figure 18:
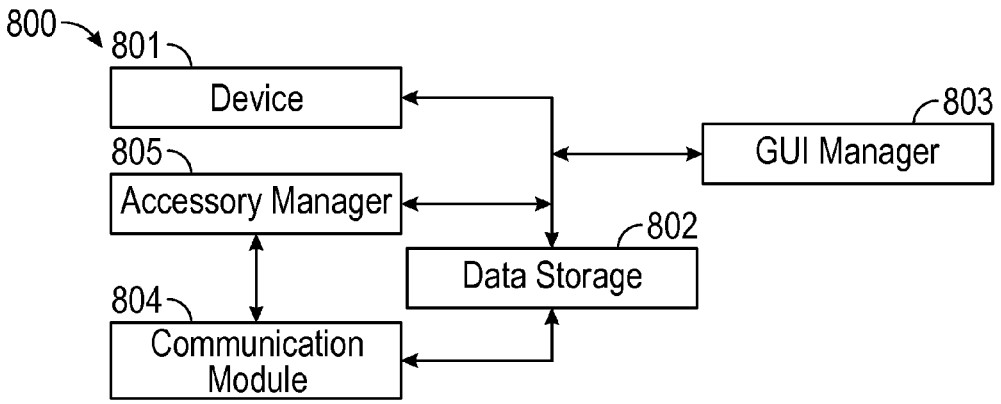
FIG. 18 is a block diagram of the functional attributes of a headphone circuit of the headphone arrangement.

FIG. 18 is a block diagram of an arrangement 800 of functional modules utilized by an audio transducer. Arrangement 800 includes an audio transducer 801 digital display device that is able to output media for a user of the headphone apparatus but also store and retrieve data with respect to data storage 802. Arrangement 800 also includes a graphical user interface (GUI) manager 803. The GUI manager 803 operates to control information being provided to and displayed on the digital display device. Arrangement 800 also includes at least one communication module 804, (such as Wi-Fi, Bluetooth, 3G, 4G, etc. . . . ), that facilitates communication between the audio transducer (headphone unit), the attached, removable and wearable digital display device, and/or at least one electronic device, such as a 'smart-connected-device', portable media player device, an electronic device such as a; TV, VCR, DVD player, TV console, TV set box, alarm system, stereo theater system (for home or vehicle), game player, game station, digital camera, video player, desktop, or other types of electronic device. Still further, arrangement 800 includes an accessory manager 805 that operates to authenticate and acquire data that is communicated with an electronic device.

Figure 19A:
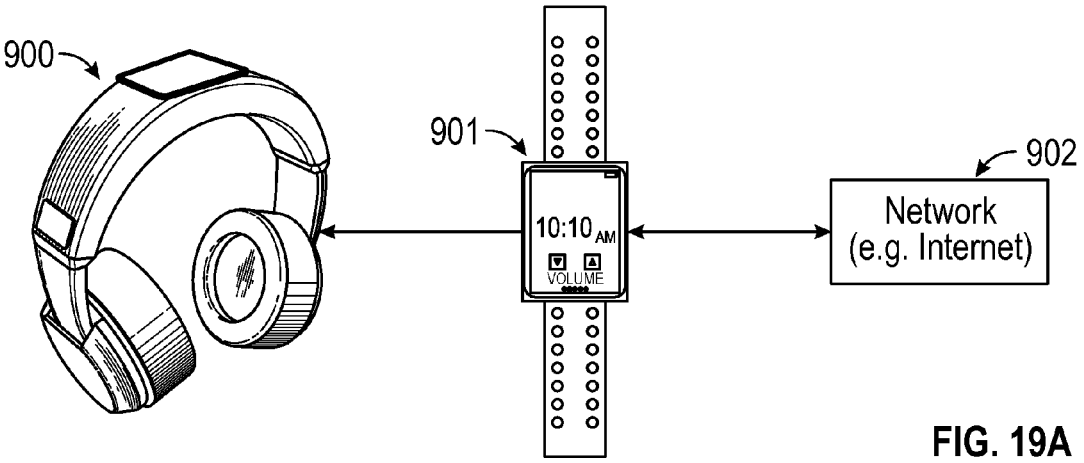
FIG. 19A is a diagram of wireless signal interactions between the headphone arrangement and the remote control, and the remote control and a network.
Figure 19B:
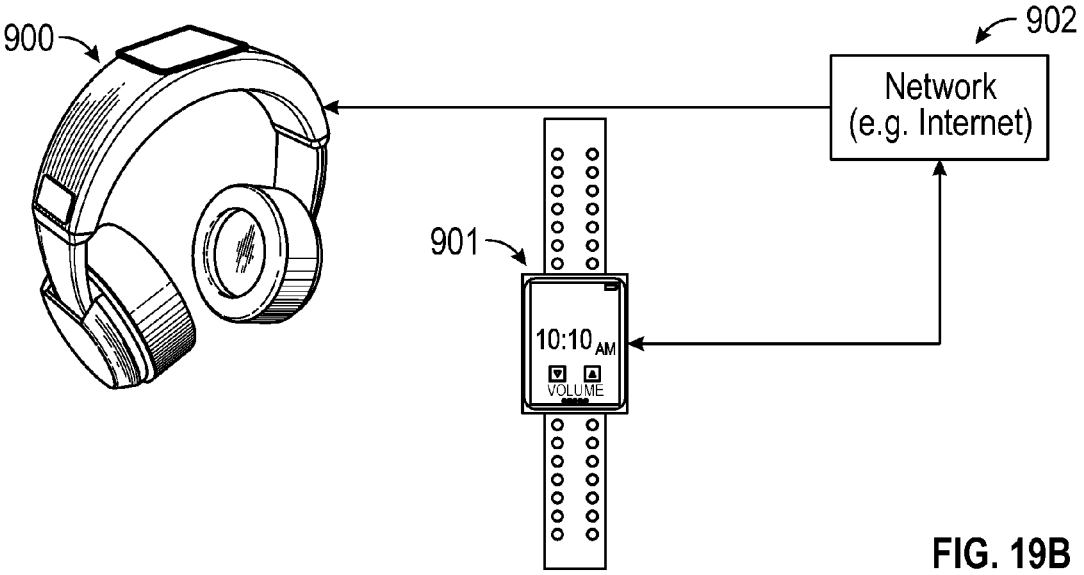
FIG. 19B is a diagram of wireless signal interactions between the headphone arrangement and the network, and the remote control and the network.

FIGS. 19A-B illustrate an arrangement 900 of audio transducer.

Arrangement FIG. 19A includes a headphone apparatus 900, a digital display 901 device, and at least one network (e.g. internet) 902. FIG. 19A illustrates communications between the digital display 901 device and at least one network (e.g. internet) 902, where data and information is sent and received between the devices. In this design configuration, the digital display device 901 receives media input from at least one network (e.g. internet) 902, encodes and sends the media to the headphone apparatus 900 which decodes and plays the audio content. In this first preferred embodiment, the digital display 901 device controls encoding and compression quality and techniques while the headphone apparatus 900 decompresses and decodes the wireless streaming media content that comes from at least one network (e.g. internet) 902. With such design configuration, a user can listen to media from the 'Cloud', (e.g. Apple iTunes Radio, Spotify, Pandora, Google Music All Access, Amazon Music, Nokia Music, RedBox, Sirius Radio, or other services for Music, Movies, Books, and other types of media . . . all trademark owned by their respective trademark holders throughout this application) to the Audio Transducer Apparatus 900.

This arrangement enables the digital display 901 device to be configured to provide all forms of internet inputs such as; Social Media, (e.g. Facebook, Twitter, Tumblr, Instragram, U-tube, Weibo, RenRen, Kaixin001, Youku, Tudou, Taobao, Linkedin), email notifications, and Messenger functions to the user by the digital display 901 device utilizing at least one network connection configuration, such as through a wireless router, cellular phone network, or other wireless spectrum or split spectrum.

Arrangement FIG. 19B includes a headphone apparatus 900, a digital display 901 device, and at least one network (e.g. internet) 902. FIG. 19B illustrates communication and remote control functions by the digital display 901 device directly to at least one network (e.g. internet) 902. In this design configuration media is sent directly to the headphone apparatus 900 from at least one network (e.g. internet) 902, and the digital display 901 device communicates remote control user selections and functions directly to at least one network (e.g. internet) 902. In this case, large data files or media is sent directly to the headphone device 900 where it is decoded, decompressed, and played, and where user control functions are provided through the digital display 901 devices GUI, graphic user interface, and a plurality of downloadable applications, Apps, utilizing small amounts of data sent and received from and to the digital display 901 device and at least one network (e.g. internet) 902. In this preferred embodiment, the digital display 901 device can be configured utilizing Bluetooth, Wi-Fi or other standard while the headphone apparatus 900 can be configured utilizing Hi-Fi, Wi-Fi, FM, AM, 3G, 4G, 5G, 6G or any other wireless spectrum with at least one network (e.g. internet) 902.

Figure 19C:
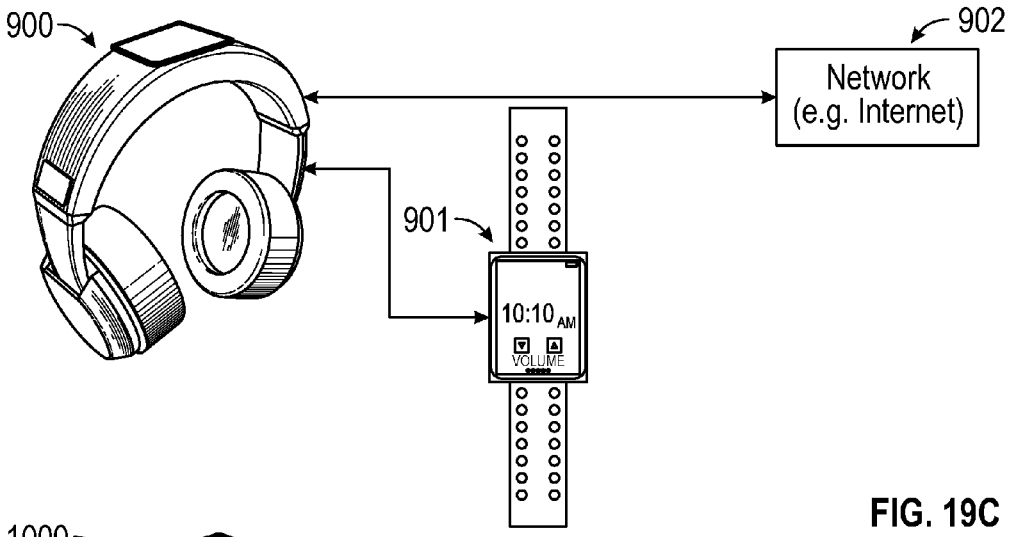
FIG. 19C is a diagram of wireless signal interactions between the headphone arrangement and the network, and the remote control and the headphone arrangement.

In an alternative embodiment, illustrated in FIG. 19C, the digital display 901 device could inversely be designed to communicate remote control functions directly between the headphone apparatus 900, when received would be processed and sent by the headphone apparatus 900 to at least one communications network (e.g. internet) 902 for controlling all types of media and content.

Figure 20A:
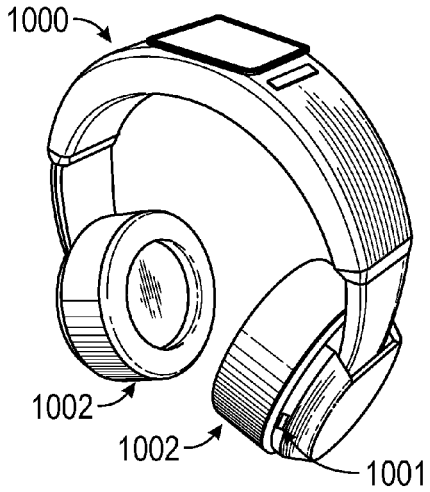
FIG. 20A is a perspective view of an embodiment of the headphone arrangement having a microphone.
Figure 20B:
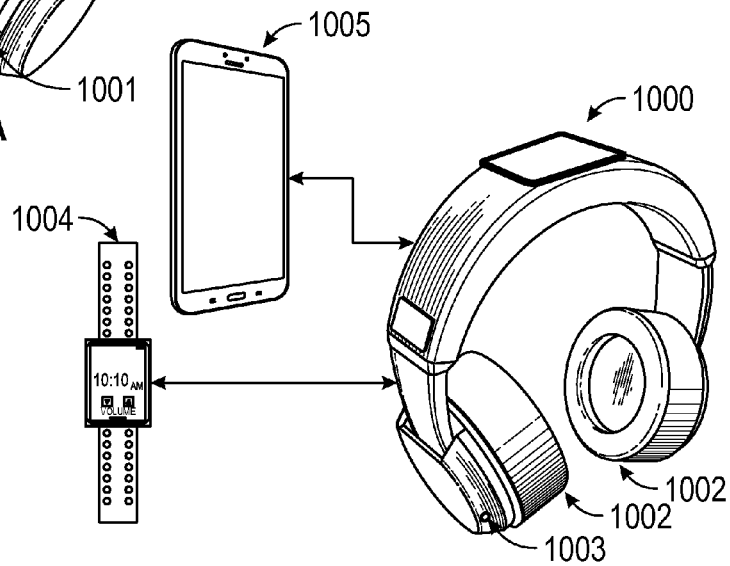
FIG. 20B is a perspective view of an embodiment of the headphone arrangement having a camera.

FIGS. 20A-B illustrate an arrangement 1000 of an audio transducer.

Arrangement FIG. 20A includes a headphone apparatus 1000 with at least one incorporated microphone 1001 for providing audible input. FIG. 20A illustrates at least one incorporated microphone 1001 to the audio transducer apparatus. The audio transducer apparatus 1000 possesses a left ear and a right ear speaker 1002 for providing audible data and information for user listening.

Arrangement FIG. 20B includes a headphone apparatus 1000 with at least one incorporated camera 1003 for providing at least one form of photo capturing, sharing, or storage capabilities and video capturing, sharing and storage capabilities. With this arrangement, the audio transducer can take photos and video and immediately post on (Instrgram, U-tube, Facebook, Tumblr, Twitter, Weibo, RenRen, Kaixin001, Youku, Tudou, Taobao, Linkedin, Line, email, Messenger, other Social Media platforms, or online and off-line storage platforms).

Users can control camera and video functions 1003 of the headphone apparatus 1000 through the audio transducers incorporated wearable digital display device 1004. With this arrangement, users can easily take photos and video on-the-fly without having to utilize their smart phone, giving them multi-device multi-tasking capabilities and since a smart phone only possesses one screen, not having to interrupt user communications on their smart phone to be able to facilitate photos and video creation and posting on-the-fly provides more conveniences to the user.

An alternative embodiment to the art enables the user to control camera and video functions of the headphone apparatus 1000 through any type of configured electronic device, such as a 'smart-connected-device' 1005.

Figure 21:
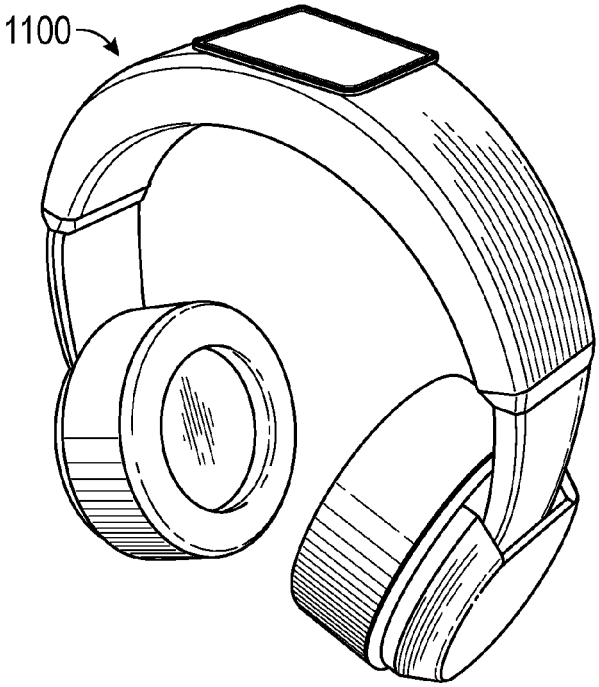
FIG. 21 is a perspective view of an embodiment of the headphone arrangement having an integrated remote control holder and personal attachment holder.
Figure 22:
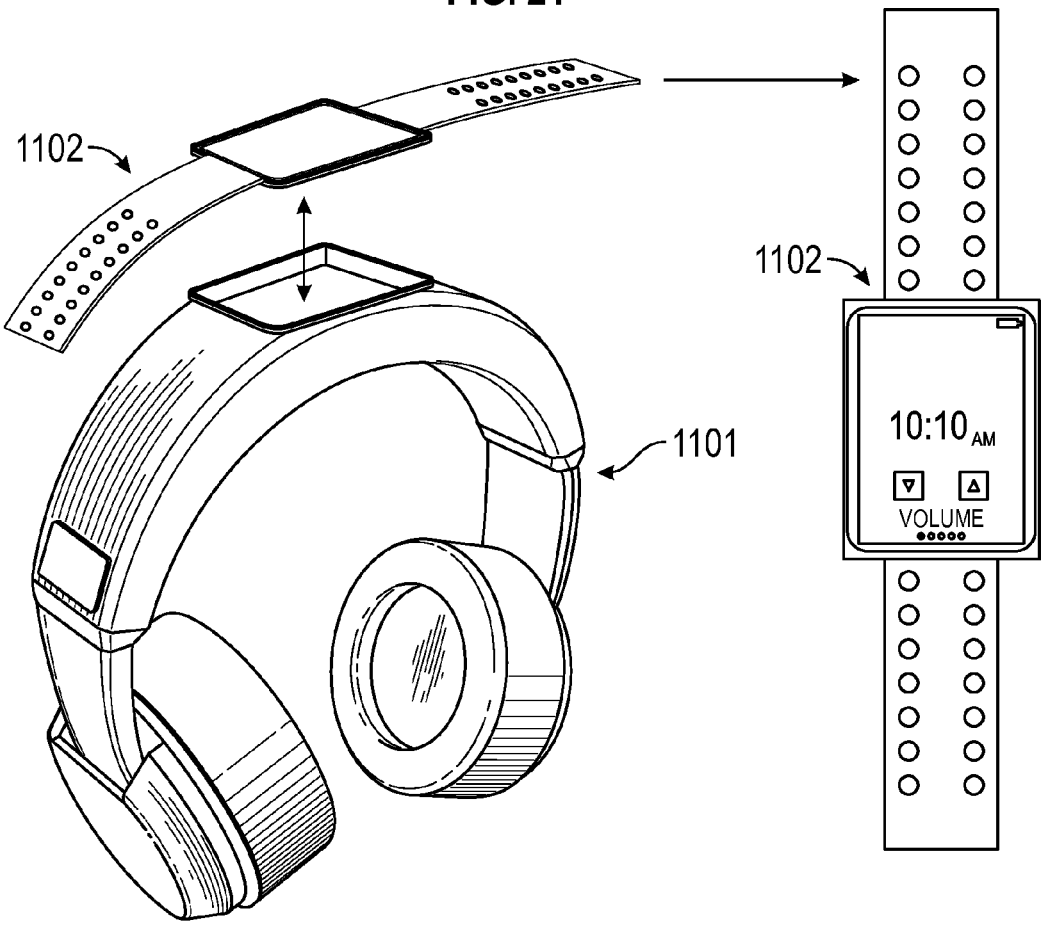
FIG. 22 is an exploded view of FIG. 21.

FIGS. 21 and 22 illustrate an arrangement 1100 of an audio transducer. Arrangement 1100 includes a headphone apparatus 1101 that enables the user to remove the attached digital display device 1102 with at least one type of incorporated strap, bracelet, band, clasp, necklace, (accessories), enabling the device to easily be worn by the user in a variety of convenient locations.

The user can still utilize the headphone apparatus 1101 by in-line wire means without removal of the digital display device 1102 by the user simply inserting the in-line wire attached to the headphone apparatus 1101 of the audio transducer 1100 into an electronic device, such as a 'smart-connected-device', to provide listening to the user. If power resources of the audio transducer 1100 are required, thus saving power resources from say a small, portable electronic device, the audio transducer 1100 may possess circuitry that detects electronic current flow, vibration from audible media, or other triggering mechanism that informs the audio transducer 1100 of its use and can automatically turn power resources On for the user. The same circuitry can equally be utilized to automatically turn Off power resources to the audio transducer 1100 when the user is no longer utilizing the audio transducer 1100.

The FIG. 21 arrangement shows a particular design configuration for an audio transducer in its original form.

The FIG. 22 arrangement shows the digital display device 1102 device being removed from the headphone apparatus 1101 enabling the d digital display device 1102 to be worn by the user in a variety of convenient locations. This illustration shows that when the digital display device 1102 is attached to the headphone apparatus 1101 the incorporated strap, bracelet, or band is hidden inside and unexposed within the upper padding of the apparatus 1101. Only the digital display device 1102 screen is exposed in its storage location.

Once the user removes the digital display device 1102 from the headphone apparatus 1101, a sensor (not shown) detects and automatically turns ON the digital display device 1102, and if required the headphone apparatus 1101, for the user to begin use.

The same holds true when the user re-attaches the digital display device 1102 to the headphone apparatus 1101 where the headphones apparatus 1101 and digital display device 1102 can be configured to automatically turn OFF for the user.

User Preferences exist within the File Manager and Graphic User Interface, GUI, of the digital display device 1102, or can be downloaded by the user onto to their electronic device, such as a 'smart-connected-device' (not shown), allowing the user to configure various actions, (e.g. ON, OFF, sleep, hibernate, pause or play music, answer or hang up a call, skip, f-forward, rewind, repeat, and more), based upon removal or attachment of the digital display 1102 device to and from the headphones apparatus 1101.

With this type of design configuration, the headphones apparatus 1101 does not require a physical On/Off button. Only when a user utilizes the headphones apparatus 1101 would the headphone automatically be turned ON for the user. The same holds true for the digital display 1102 device. Only when the user removes the digital display device 1102 from the headphones apparatus 1101 would power resources be required, and if there exists a time when the user wishes to utilize the digital display 1102 device without removing it from the headphones apparatus 1101, user preferences are provided to the user on the digital display device 1102 or an electronic device, such as a 'smart-connected-device' (not shown), can be configured to provide different user settings quickly and easily.

Arrangement shows the headphones apparatus 1101 may be designed to hold more than one type of incorporated strap, bracelet, or band, clip, clasp, necklace, or other type of accessory that can enable the user to select from a variety of accessory items to wear, arrange, or fashion for easy accessibility to the digital display device 1102 by the user.

What is claimed is:

1. An audio playback system for an audio signal generated by an audio output device for use by a person, comprising:

a generally U-shaped headphone arrangement having two opposing ends each terminating with an audio transducer, and a top enclosure having a remote control holder, a remote sensor, a personal attachment holder, a headphone circuit having a signal input adapted to receive the audio signal generated by the audio output device, a power source, a wireless control signal input, and an audio output electrically connected with each audio transducer; and a remote control comprising an enclosure adapted for selective engagement with the remote control holder of the headphone arrangement and subject to detection by the remote sensor, a remote circuit having a control signal transmitter, a power source, and a user interface; and a personal attachment adapted in a worn configuration to be fixed with the enclosure of the remote control and for selective attachment with the person, and in a stowed configuration to be fixed with the personal attachment holder of the headphone arrangement;

whereby with the person wearing the personal attachment fixed with the remote control, control signals are transmitted to the control signal input of the headphone arrangement by the control signal transmitter in response to the person interacting with the user interface, the headphone circuit altering the audio output of the headphone circuit in accordance thereto, and whereby with the personal attachment and remote control stowed in the headphone arrangement the headphone circuit is deactivated by the remote sensor.

2. The audio playback system of claim 1 further including a remote control release mechanism that includes a remote control catch mechanically fixed with a remote control release, whereby upon actuation of the remote control release the remote control catch releases the remote control from the remote control holder.

3. The audio playback system of claim 2 wherein the remote sensor is a switch integrated with the remote control release mechanism.

4. The audio playback system of claim 1 wherein the personal attachment is a wristband selectively engageable with the remote control enclosure and storable in the personal attachment holder of the headphone arrangement.

5. The audio playback system of claim 1 wherein the personal attachment is a clasp fixed with the remote control enclosure, and wherein the personal attachment holder and the remote control holder of the top enclosure of the headphone arrangement are mutually integrated, the clasp configured for select attachment with a garment of the person.

6. The audio playback system of claim 1 wherein the personal attachment is a necklace fixed with the remote control enclosure, and wherein the personal attachment holder and the remote control holder of the top enclosure of the headphone arrangement are mutually integrated, the necklace configured for select attachment about the neck of the person.

7. The audio playback system of claim 1 wherein the signal input of the headphone circuit is an electronic jack traversing the headphone arrangement and adapted for selectively receiving an audio plug of an audio signal line electrically connected with the audio output device.

8. The audio playback system of claim 1 wherein the signal input of the headphone circuit is a wireless signal receiver, and wherein the audio signal is a wireless audio signal.

9. The audio playback system of claim 8 wherein the remote circuit further includes a second signal input adapted to receive the audio signal generated by the audio output device, and an audio signal transmitter for transmitting the audio signal to the signal input of the headphone circuit.

10. The audio playback system of claim 9 wherein the second signal input of the remote circuit is an electronic jack traversing the enclosure of the remote control and adapted for selectively receiving an audio plug of an audio signal line electrically connected with the audio output device.

11. The audio playback system of claim 9 wherein the second signal input of the remote circuit is a wireless signal receiver, and wherein the audio signal is a wireless audio signal.

12. The audio playback system of claim 1 wherein the user interface of the remote control includes a touch-sensitive display screen, whereby variable user interface controls are displayed to the person on the display screen and changed by the person by interacting with the display screen, the remote circuit further including a processor and a memory.

13. The audio playback system of claim 11 wherein the user interface of the remote control includes a touch-sensitive display screen, whereby variable user interface controls are displayed to the person on the display screen and changed by the person by interacting with the display screen, the remote circuit further including a processor and a memory, and wherein the second signal input of the remote circuit is adapted for additionally receiving non-audio wireless signals and changing the display screen in accordance with such non-audio wireless signals.

14. The audio playback system of claim 13 wherein the control signal transmitter is configured for sending control signals to both the headphone arrangement and the audio output device.

15. The audio playback system of claim 12 wherein the user interface of the remote control further includes a microphone, and wherein the remote circuit is adapted for receiving commands from the person by voice recognition.

16. The audio playback system of claim 12 wherein the user interface of the remote control further includes a camera, and wherein the remote circuit is adapted for receiving commands from the person by gesture recognition.

17. The audio playback system of claim 12 wherein the user interface of the remote control further includes at least one tilt sensor, and wherein the remote circuit is adapted for receiving commands from the person by tilting of the remote control.

18. The audio playback system of claim 12 wherein the remote circuit further includes a wireless interface accessible through a wireless communications network, the wireless interface adapted for loading selected software applications into the memory through the wireless communications network, the remote circuit further including an open-source operating system programmed into the memory.

19. The audio playback system of claim 18 wherein the audio signal is received over the wireless communications network.

20. The audio playback system of claim 14 wherein the headphone circuit further includes a second tilt sensor and a feedback transmitter, and wherein the remote circuit further includes a feedback signal receiver, whereby upon detection by the second tilt sensor that the orientation of the headphone arrangement has been changed by the person, the headphone circuit sends a feedback signal to the remote circuit whereby the remote circuit takes a pre-programmed action.

21. The audio playback system of claim 19 wherein the preprogrammed action is to send a pause command to the audio output device through the control signal transmitter in response to the second tilt sensor detecting that the headphone arrangement has assumed a horizontal orientation.

22. The audio playback system of claim 19 wherein the preprogrammed action is to send a play command to the audio output device through the control signal transmitter in response to the second tilt sensor detecting that the headphone arrangement has assumed a vertical orientation.

23. The audio playback system of claim 1 wherein at least a second generally U-shaped headphone arrangement having two opposing ends each terminating with one of the audio transducers, a second headphone circuit, each headphone arrangement adapted to receive the control signals generated by the remote control.

24. The audio playback system of claim 12 wherein the headphone circuit further includes a microphone and a feedback transmitter, and wherein the remote circuit further includes a feedback signal receiver and is adapted for receiving an audio signal from the microphone through the headphone circuit.

25. The audio playback system of claim 12 wherein the headphone circuit further includes a camera and a feedback transmitter, and wherein the remote circuit further includes a feedback signal receiver and is adapted for receiving video signals from the camera through the headphone circuit.

26. The audio playback system of claim 8 wherein the headphone circuit includes a processor and a memory and is adapted to decompress a compressed audio signal.

27. The audio playback system of claim 8 wherein the headphone circuit includes a processor and a memory and is adapted to decode an encoded audio signal.

28. The audio playback system of claim 19 wherein the control signal transmitter is configured for sending control signals to the headphone arrangement, the audio output device, and through the wireless network.

* * * * *